US012590782B2

(12) United States Patent
Boezi, III et al.

(10) Patent No.: US 12,590,782 B2
(45) Date of Patent: Mar. 31, 2026

(54) ARCHERY BOW SIGHT SUPPORT SYSTEMS

(71) Applicant: Ultraview Archery, Inc., Norcross, GA (US)

(72) Inventors: John Boezi, III, Norcross, GA (US); Zachary Bruce Harris, Norcross, GA (US); Simon Yimeng Li, Norcross, GA (US); Kolby John Hanley, Norcross, GA (US); William Sauway Law, Norcross, GA (US); Ron Jack Smith, Norcross, GA (US)

(73) Assignee: Ultraview Archery, Inc., Norcross, GA (US)

( * ) Notice: Subject to any disclaimer, the term of this patent is extended or adjusted under 35 U.S.C. 154(b) by 328 days.

(21) Appl. No.: 18/234,500

(22) Filed: Aug. 16, 2023

(65) Prior Publication Data

US 2025/0060195 A1 Feb. 20, 2025

(51) Int. Cl.
*F41G 1/467* (2006.01)

(52) U.S. Cl.
CPC ..... *F41G 1/467* (2013.01)

(58) Field of Classification Search
CPC ..... F41G 4/167
USPC ..... 33/265
See application file for complete search history.

(56) References Cited

U.S. PATENT DOCUMENTS 5,384,966 A * 1/1995 Gibbs ..... F41G 1/467 124/87
6,446,347 B1 * 9/2002 Springer ..... F41G 1/467 124/87
6,609,306 B2 * 8/2003 Johnson ..... F41G 1/467 124/87
6,802,129 B1 * 10/2004 Wirth ..... F41G 1/467 124/87
7,086,161 B2 * 8/2006 Ellig ..... F41G 1/467 124/87
7,278,216 B2 10/2007 Grace
7,308,891 B2 12/2007 Graf
7,360,313 B1 4/2008 Hamm et al.
7,610,686 B1 11/2009 Summers et al.
7,832,109 B2 11/2010 Gibbs
7,900,365 B1 3/2011 Johnson
8,151,473 B2 4/2012 Sims et al.
(Continued)

*Primary Examiner* — George B Bennett
(74) *Attorney, Agent, or Firm* — TROUTMAN PEPPER LOCKE LLP; Christopher C. Close, Jr.; Korbin M. Blunck

(57) ABSTRACT

The disclosed technology includes a support system for an optical sighting device of a bow. The support system includes a support structure configured to attach to a bow and an elevation assembly configured to move along an elevation direction relative to the support structure. The support structure can include an elevation actuator configured to cause the elevation assembly to move along the elevation direction when the elevation actuator is actuated and a windage assembly configured to move along a windage direction relative to the support structure. The windage direction can be approximately perpendicular to the elevation direction. The support structure can further include a windage actuator configured to cause the windage assembly to move along the windage direction when the windage actuator is actuated. The windage actuator can be disposed at least partially in the elevation actuator.

20 Claims, 29 Drawing Sheets

(56) References Cited

U.S. PATENT DOCUMENTS

| | | | | |
|---|---|---|---|---|
| 8,161,656 | B1 | 4/2012 | Ellgass | |
| 8,171,648 | B2 | 5/2012 | Summers et al. | |
| 8,689,454 | B2 * | 4/2014 | Pulkrabek | F41G 1/467 124/87 |
| 8,904,655 | B1 * | 12/2014 | Larson | F41G 1/467 33/265 |
| 9,097,491 | B2 | 8/2015 | Summers et al. | |
| 9,612,087 | B2 | 4/2017 | Summers et al. | |
| 9,797,684 | B2 | 10/2017 | Mason et al. | |
| 10,228,218 | B2 | 3/2019 | Mason et al. | |
| 10,907,933 | B1 * | 2/2021 | Hamm | F41G 1/467 |
| 11,698,243 | B2 | 7/2023 | Mason | |
| 2005/0150119 | A1 | 7/2005 | Ellig et al. | |
| 2007/0227018 | A1 * | 10/2007 | Ellig | F41G 1/467 33/265 |
| 2015/0082643 | A1 * | 3/2015 | Summers | F41G 1/467 33/265 |
| 2024/0159501 | A1 * | 5/2024 | Dalton | F41G 1/467 |
| 2025/0341382 | A1 * | 11/2025 | Compton | F41G 3/065 |

* cited by examiner

Section A-A

Section A-A

*Section AA-AA*

Section E-E

Section B-B

Section C-C

Section D-D

Section G-G

Section G-G

*Section F-F*

Section J-J

Section I-I

Section H-H

Section F-F

Section F-F

Section L-L

Section L-L

Section K-K

Section K-K

Section M-M

ARCHERY BOW SIGHT SUPPORT SYSTEMS

FIELD OF THE INVENTION

This disclosure relates generally to optical sighting devices and assemblies, and more particularly to supports for optical sighting devices and assemblies.

BACKGROUND OF THE INVENTION

Generally, optical sighting devices used in archery can be used to view a target and to align an arrow to be released from the bow with a target. Some current optical sighting devices include a lens, an aiming point, reticle, up pin, or the like either attached to the lens or otherwise in the sight line of the optical sighting device.

Many optical sighting devices are attached to bows using a support structure that can be adjusted to move the optical sighting device in an elevation direction (e.g., an upward and downward direction) and a windage direction (e.g., a side to side direction). The support structure can be adjusted to properly align the optical sighting device with the bow such that an arrow released from the bow has a greater chance of hitting the intended target. Many support structures for optical sighting devices, however, can be difficult to operate, difficult to properly align, become misaligned over time due wear or impact, and are not designed for quick adjustments which can be helpful, for example, when bow hunting. These and other problems are addressed by the disclosed technology.

BRIEF SUMMARY OF THE INVENTION

The disclosed technology includes a support system for an optical sighting device of a bow. The support system includes a support structure configured to attach to a bow and an elevation assembly configured to move along an elevation direction relative to the support structure. The support structure can include an elevation actuator configured to cause the elevation assembly to move along the elevation direction when the elevation actuator is actuated and a windage assembly configured to move along a windage direction relative to the support structure. The windage direction can be approximately perpendicular to the elevation direction. The support structure can further include a windage actuator configured to cause the windage assembly to move along the windage direction when the windage actuator is actuated. The windage actuator can be disposed at least partially in the elevation actuator.

The disclosed technology includes a support system for an optical sighting device of a bow. The support system can comprise an elevation assembly configured to move along an elevation direction relative to the support structure. The elevation assembly can comprise a pinion gear and the pinion gear can comprise angled teeth that converge toward each other from a first side of the pinion gear to a second side of the pinion gear. The support system can include a rack gear comprising corresponding angled teeth that converge toward each other from a second side of the rack gear to a first side of the rack gear. The first and second sides of the pinion gear can correspond to the first and second sides of the rack gear. The support system can further include an O-ring configured to apply a force to the pinion gear along an axis of the pinion gear to cause the angled teeth to engage with the corresponding angled teeth of the rack gear.

The disclosed technology includes a support system for an optical sighting device of a bow, the support system can include a support structure configured to attach to a bow and an elevation assembly configured to move along an elevation direction relative to the support structure. The elevation assembly can comprise a pinion gear. The pinion gear can comprise an aperture extending therethrough along an axis of the pinion gear. The elevation assembly can further include an elevation actuator configured to engage the pinion gear and cause the elevation structure to move along the elevation direction when the elevation actuator is actuated.

The support structure can include a windage assembly configured to move along a windage direction relative to the support structure. The windage direction can be approximately perpendicular to the elevation direction. The windage assembly can include a windage actuator extending at least partially through the aperture of the pinion gear and configured to cause the windage assembly to move along the windage direction when the windage actuator is actuated.

The disclosed technology can include a windage assembly for a bow sight. The windage assembly can include a shaft configured to support the bow sight, a lead screw configured to engage the shaft, and a wheel attached to the lead screw. The wheel can be configured to transfer a torque to the lead screw thereby causing the shaft to rotate and move along a windage direction. The wheel can be configured to move between a locked position and an unlocked position. When the wheel is in the locked position, the wheel can be prevented from rotating and causing the shaft to move along the windage direction. When the wheel is in the unlocked position, the wheel can be permitted to rotate and cause the shaft to move along the windage direction.

These and other aspects of the present disclosure are described in the Detailed Description below and the accompanying figures. Other aspects and features of the present disclosure will become apparent to those of ordinary skill in the art upon reviewing the following description of examples of the present disclosure in concert with the figures. While features of the present disclosure may be discussed relative to certain examples and figures, all aspects of the present disclosure can include one or more of the features discussed herein. Further, while one or more aspects may be discussed as having certain advantageous features, one or more of such features may also be used with the various examples of the disclosure discussed herein. In similar fashion, while examples may be discussed below as device, system, or method embodiments, it is to be understood that such examples can be implemented in various devices, systems, and methods of the present disclosure.

BRIEF DESCRIPTION OF THE DRAWINGS

The above and further aspects of this invention are further discussed with reference to the following description in conjunction with the accompanying drawings, in which like numerals indicate like structural elements and features in various figures. The drawings are not necessarily to scale, emphasis instead being placed upon illustrating principles of the invention. The figures depict one or more implementations of the inventive devices, by way of example only, not by way of limitation.

DETAILED DESCRIPTION OF THE INVENTION

Figure 1:
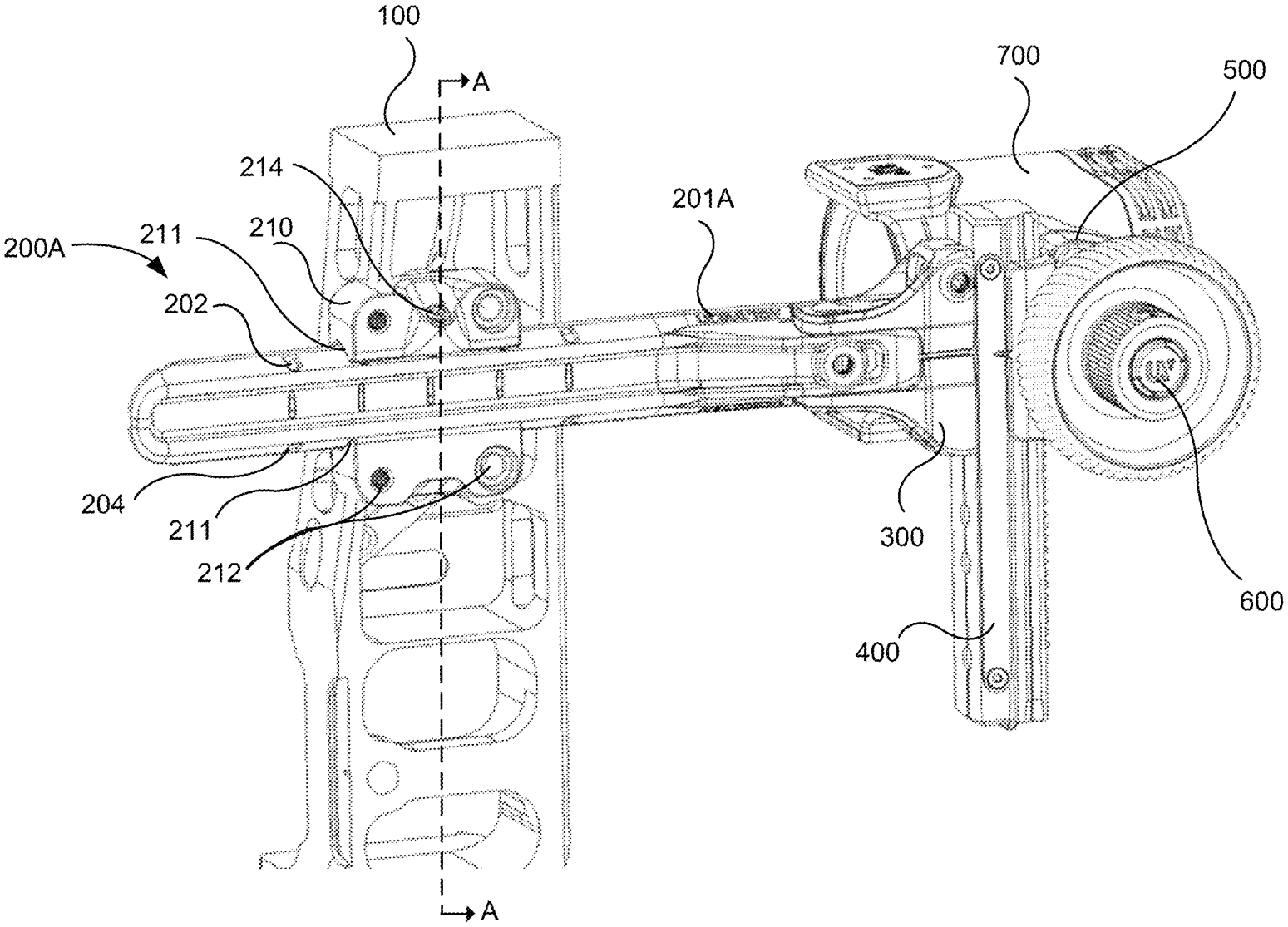
FIG. 1 is a perspective view of a bow, support structure, and bow sight, according to an example of the present disclosure.

The example embodiments disclosed herein illustrate devices and systems for a support structure for an optical sighting device. As will become apparent throughout this disclosure, the disclosed technology includes many improvements over existing support structures for optical sighting devices. For example, but not limitation, the disclosed technology includes a windage assembly having a wheel that can be disposed at least partially in a portion of an elevation assembly. To illustrate, the windage assembly can include a wheel that is disposed at least partially in a wheel of the elevation assembly. In some examples, the wheel of the windage assembly can be concentric with a wheel of the elevation assembly making it easier for a user to adjust both the elevation and windage settings of the optical sighting device.

The disclosed technology can further include a pinion and rack gear design that is configured to provide smooth movement of the pinion along the rack and consistent engagement of the gears over time. Further still, the disclosed technology can include a clamping system that can lock the elevation assembly in place but still allow a user to overcome the clamping force provided by the lock should the user have need to quickly adjust the elevation assembly. In still other examples, the disclosed technology can include a plurality of sight tapes and sight pins that can be adjusted and set for different shooting situations. The disclosed technology can further include a simplified design for quickly removing and reattaching the elevation assembly to the rack gear. Furthermore, the disclosed technology can include an improved design for a yaw block that is configured to ensure sufficient clamping force of the yaw block to a rail and easy adjustment of the yaw block. These and other features are explained in greater detail herein.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being a support system of a bow sight. The present disclosure, however, is not so limited, and can be applicable in other contexts such as support systems for bow scopes and other optical sighting devices used in archery, or support systems for optical sighting devices for firearms, inspection equipment, astronomy equipment, surveying equipment, etc. Accordingly, when the present disclosure is described in the context of a support system for a bow sight, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring now to FIG. 1 which is a perspective view of a bow 100, support structure (200, 300, 400, 500, and 600) and a bow sight 700, according to an example of the present disclosure. As will be appreciated, only a portion of the bow 100 (e.g., the riser of the bow) is shown in the figures for simplicity. As will become apparent throughout this disclosure, the support structure can include several components (200, 300, 400, 500, and 600) that are used to attach the bow sight 700 to the bow 100 and to enable a user to adjust a position of the bow sight 700 such that it is properly aligned for accurately aiming and hitting a target with an arrow released from the bow 100.

Figure 2B:
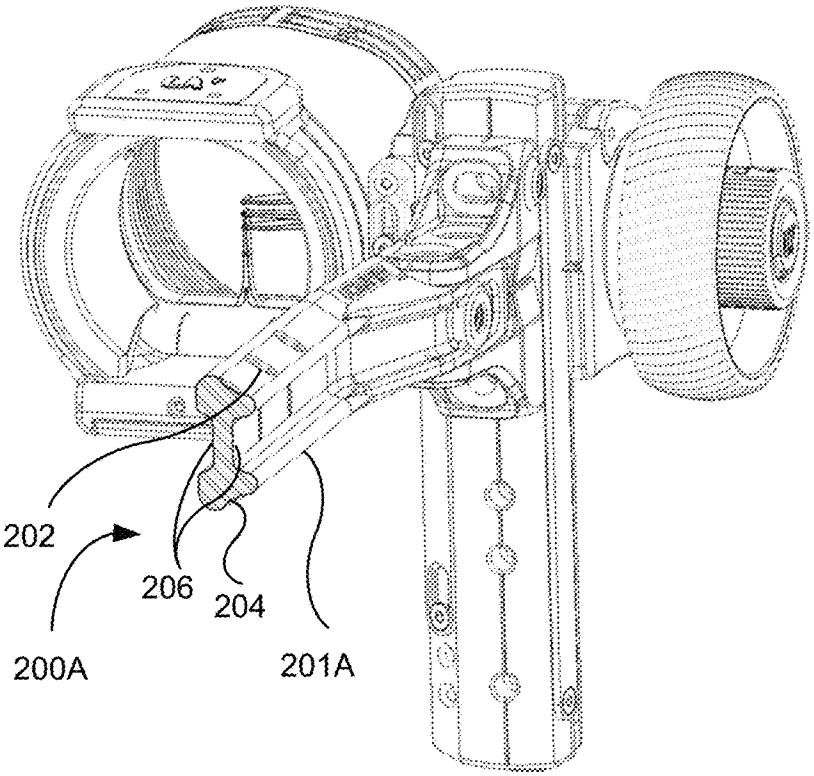
FIG. 2B is a cross-sectional view taken along line A-A of the support structure shown in FIG. 1 with the bow removed, according to an example of the present disclosure.
Figure 13:
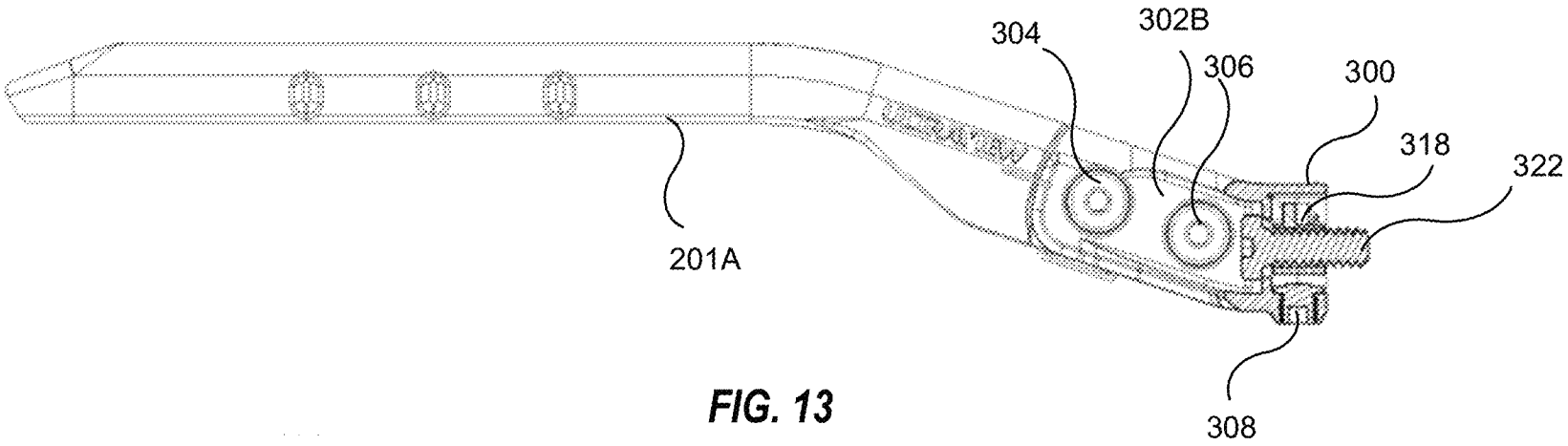
FIG. 13 is a section view of the yaw block and rail taken along line C-C of FIG. 9, according to an example of the present disclosure.
Figure 14:
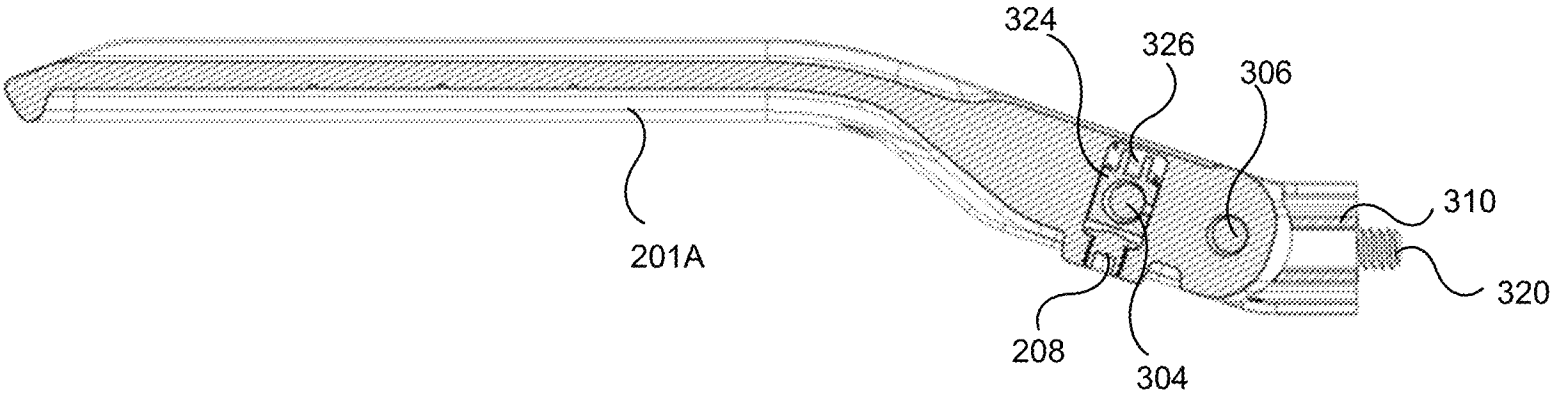
FIG. 14 is a section view of the yaw block and rail taken along line D-D of FIG. 9, according to an example of the present disclosure.

The support structure can include, but is not limited to, a rail assembly 200, a yaw block 300, a rack 400, an elevation assembly 500, and a windage assembly 600. FIGS. 1-2B illustrate a first example of a rail assembly 200A, FIGS. 3-6, and 15 illustrate a second example of a rail assembly 200B, and FIGS. 13-14 illustrate a third type of rail assembly 200C. Each of the illustrated rail assemblies can be used to attach the bow sight 700 to different types of bows 100. Each example rail assembly 200A, 200B, 200C will be described in greater detail in relation to their respective figures.

As shown in FIG. 1, the rail assembly 200A according to the first example can include a rail 201A that can be attached to a mounting block 210. The mounting block 210 can be configured to be attached to the bow 100 via one or more fasteners 212. Alternatively, or in addition, the mounting block 210 can be attached to the bow 100 via a snap fit, a clamp, a strap, or other suitable fastening device. The rail 201A can be an elongated member that can extend outwardly from the bow 100.

Figure 2A:
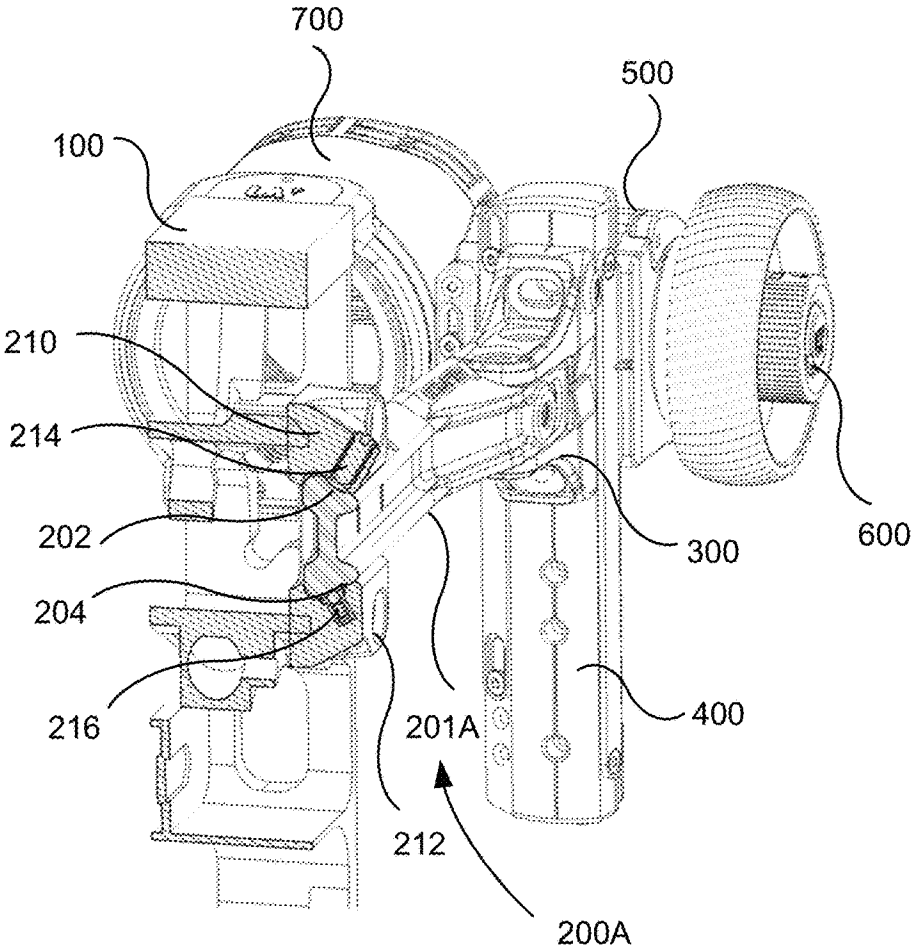
FIG. 2A is a cross-sectional view taken along line A-A of the bow, and support structure shown in FIG. 1, according to an example of the present disclosure.

FIG. 2A is a cross-sectional view taken along line A-A of the bow 100, the mounting block 210, and the rail assembly 201A while FIG. 2B is a cross-sectional view taken along line A-A with the bow 100 removed for simplicity. The positioning of the rail 201A in relation to the mounting block 210 and the bow 100 can be adjusted by sliding the rail 201A along the mounting block 210 and then securing the rail 201A in place by a set screw 214 or other securing member. As shown in FIGS. 2A and 2B, the rail 201A can have an angled profile similar to an angled I-beam. The angled profile of the rail 201A can help to reduce the weight of the rail 201A while ensuring sufficient stiffness. The mounting block 210 can include corresponding angled edges 211 that can permit the rail 201A to slide along the mounting block 210 in a first direction (i.e., along a shooting direction of the bow 100) but prevent the rail 201A from being pulled out from the mounting block 210 in a second direction (i.e., in a direction perpendicular to the shooting direction of the bow 100).

To help keep the rail 201A in place with respect to the mounting block 210, the rail 201A can include an upper recess 202 and a lower recess 204. The upper recess 202 can be configured to align with the set screw 214 and the set screw 214 can be driven at least partially into the upper recess 202 to keep the rail 201A in place. To help ensure the upper recess 202 is properly aligned with the set screw 214, the lower recess 204 can be aligned with the upper recess 202 and the mounting block 210 can include a detent 216 that can include a spring-loaded ball assembly (e.g., ball plunger) that can be pushed into the lower recess 204. As the rail 201A is slid along the mounting block 210, the detent 216 can snap into each of the lower recesses 202 enabling the user to know whether the upper recess 202 is aligned with the set screw 214. In other words, as the user slides the rail 201A along the mounting block 210, the detent 216 will push the ball into the lower recess 204 providing some resistance which the user can understand to mean that the upper recess 202 is aligned with the set screw 214.

Figure 3:
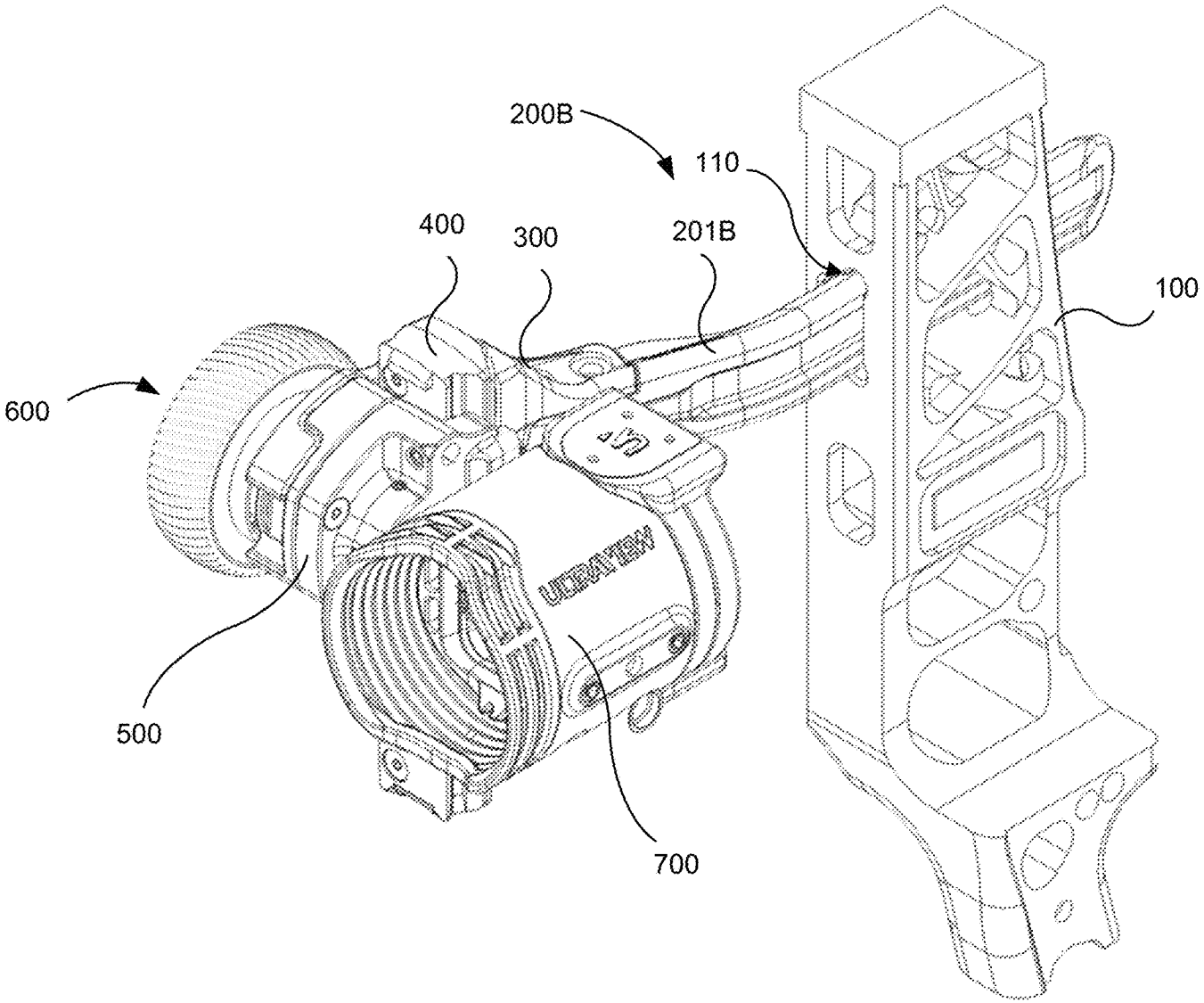
FIG. 3 is a perspective view of a bow, support structure, and bow sight, according to another example of the present disclosure.
Figure 4:
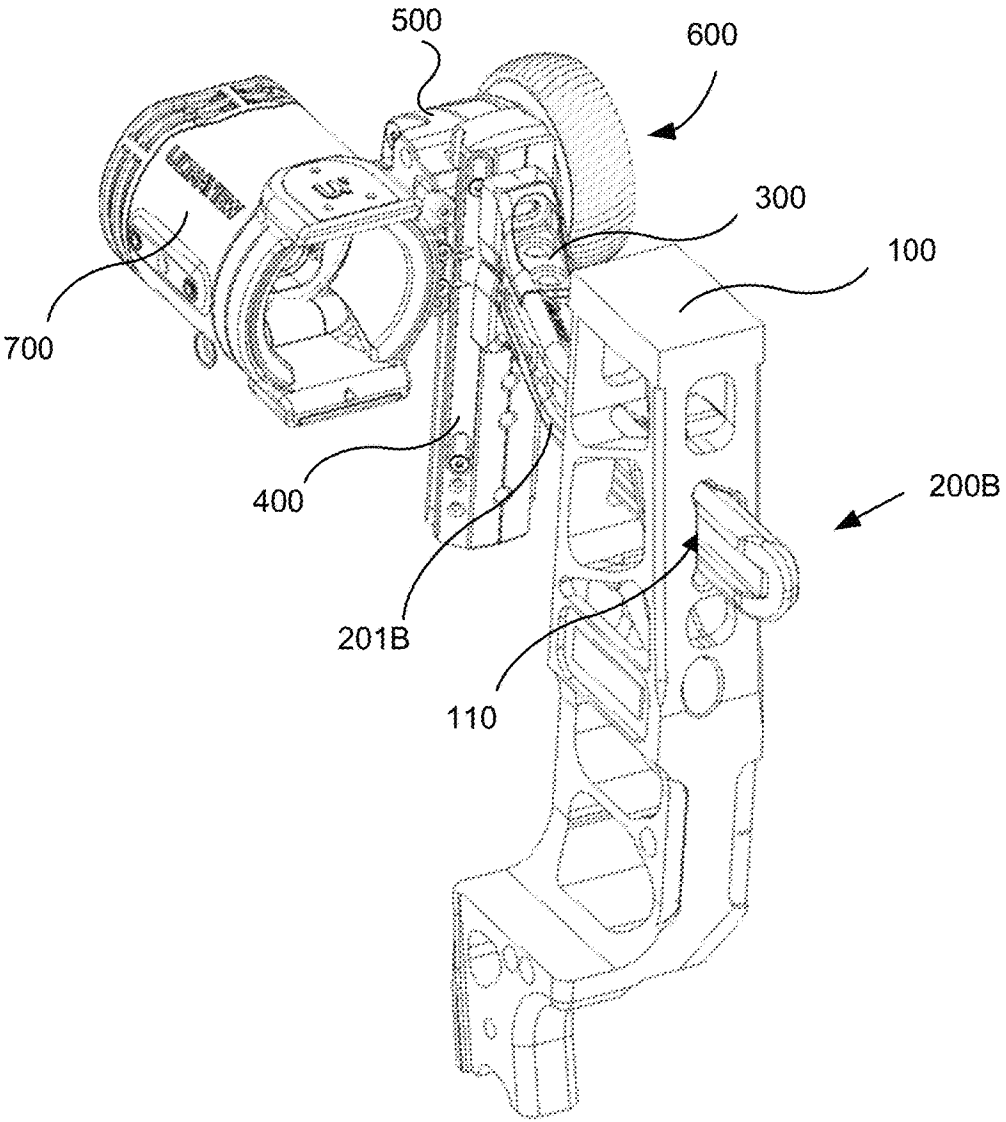
FIG. 4 is another perspective view of a bow, support structure, and bow sight shown in FIG. 3, according to an example of the present disclosure.
Figure 5:
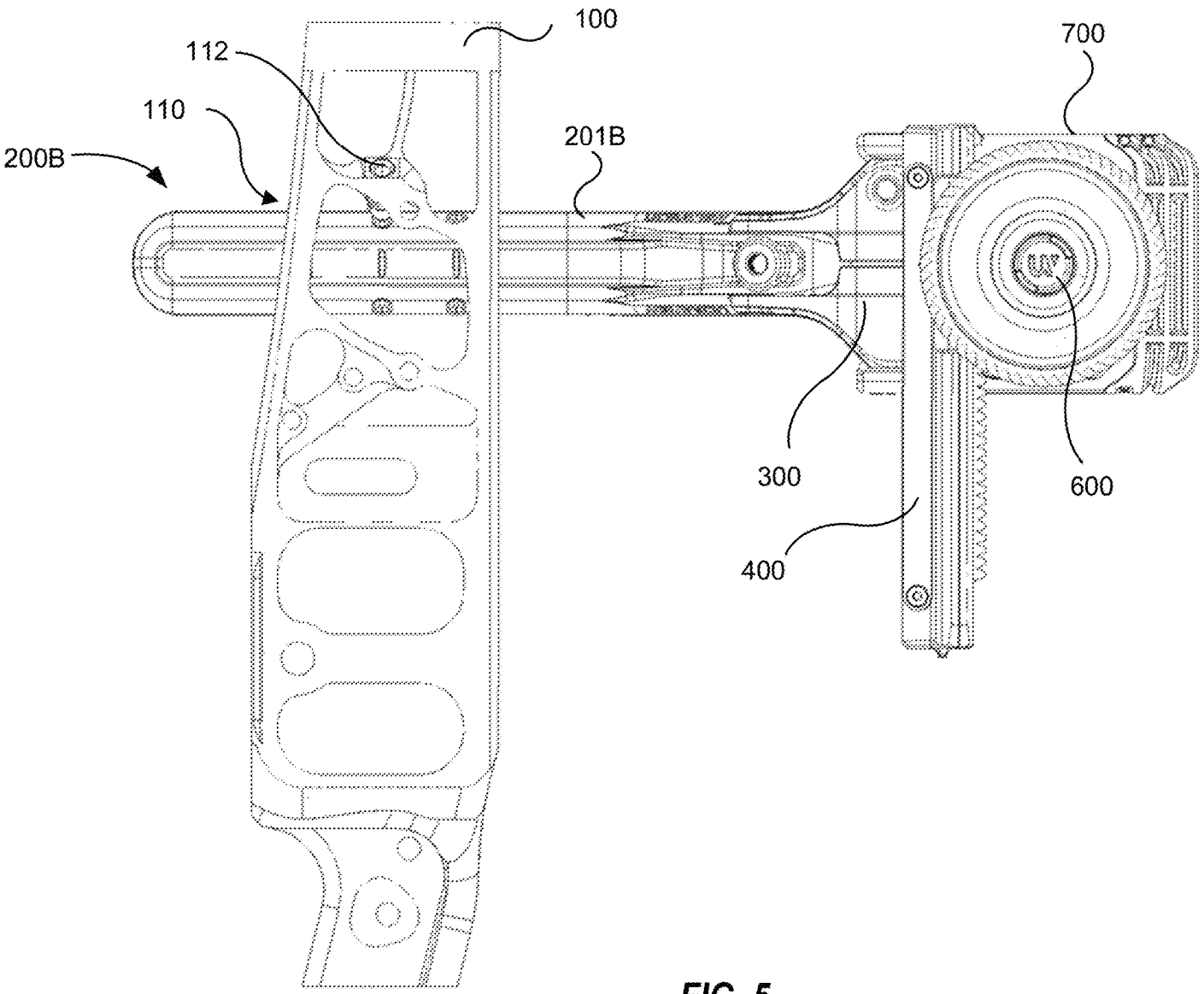
FIG. 5 is a side view of the bow, support structure, and bow sight shown in FIG. 3, according to an example of the present disclosure.
Figure 6:
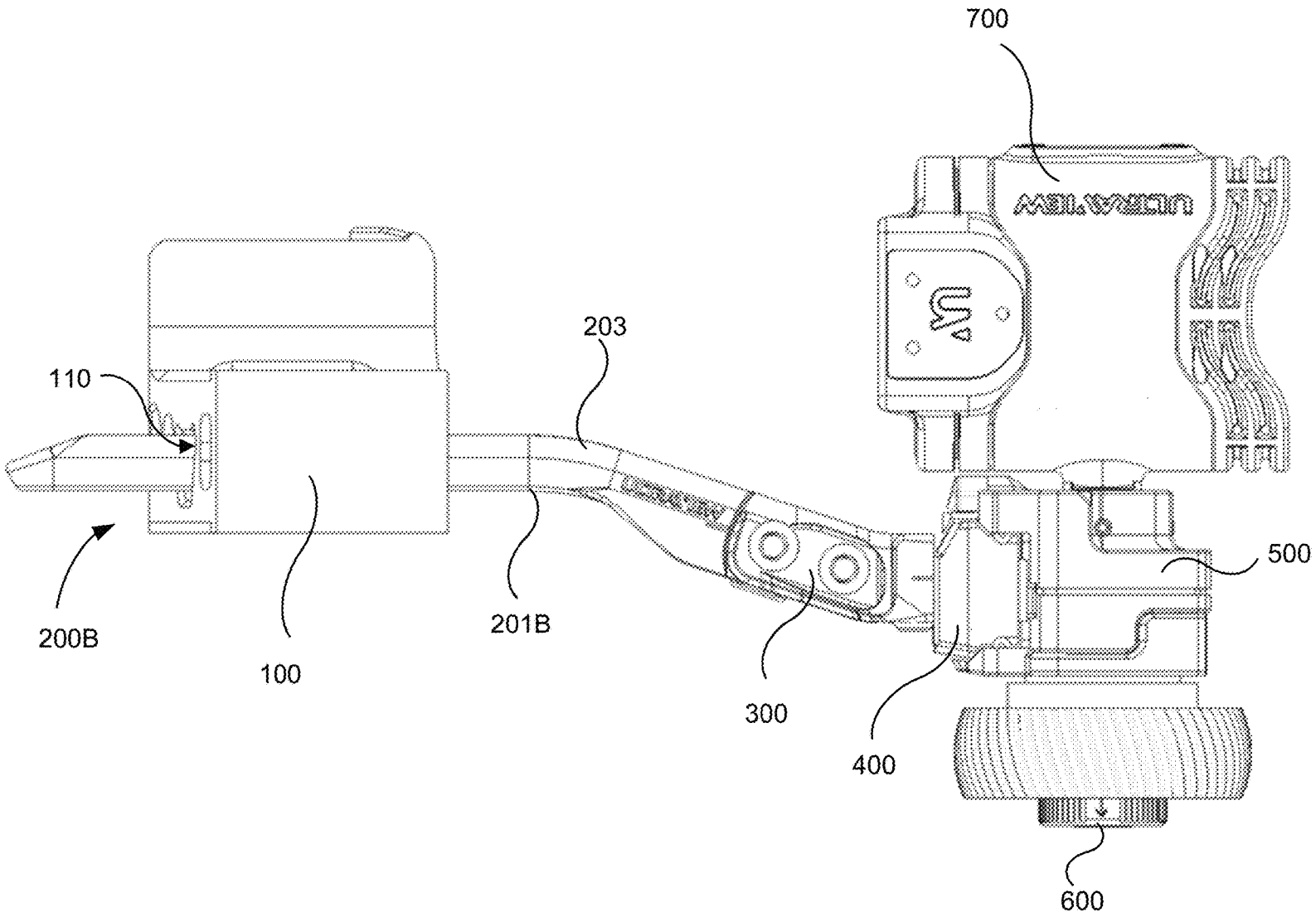
FIG. 6 is a top view of the bow, support structure, and bow sight shown in FIG. 3, according to an example of the present disclosure.

Turning now to FIGS. 3-6, the second example of the rail assembly 200B is shown and described herein. FIGS. 3 and 4 are perspective views while FIG. 5 is a side view and FIG. 6 is a top view of a bow 100, support structure (200, 300, 400, 500, and 600), and bow sight 700, according to another example of the present disclosure. The rail assembly 200B can include rail 201B and be configured to extend through an aperture 110 of the bow 100. In other words, rather than including a mounting block 210, the bow 100 can include a recess 110 that acts as the mounting block 210 to hold the rail 201B in place on the bow 100. The bow 100 can include one or more set screws 112, a clamp, a press fit, or other securing member, to keep the rail 201B in place in the aperture 110.

As shown in FIG. 6, the rail 201B can include a bend 203 to ensure the bow sight 700 is aligned with the shooting line of the bow 100. The bend 203 can be sized or otherwise configured as suitable for a given bow sight 700, bow 100, or combination of the bow sight 700 and bow 100. In other words, a larger or smaller bend 203 can be formed into the rail 201B to ensure the bow sight 700 is aligned with the shooting line of the bow 100.

Figure 7A:
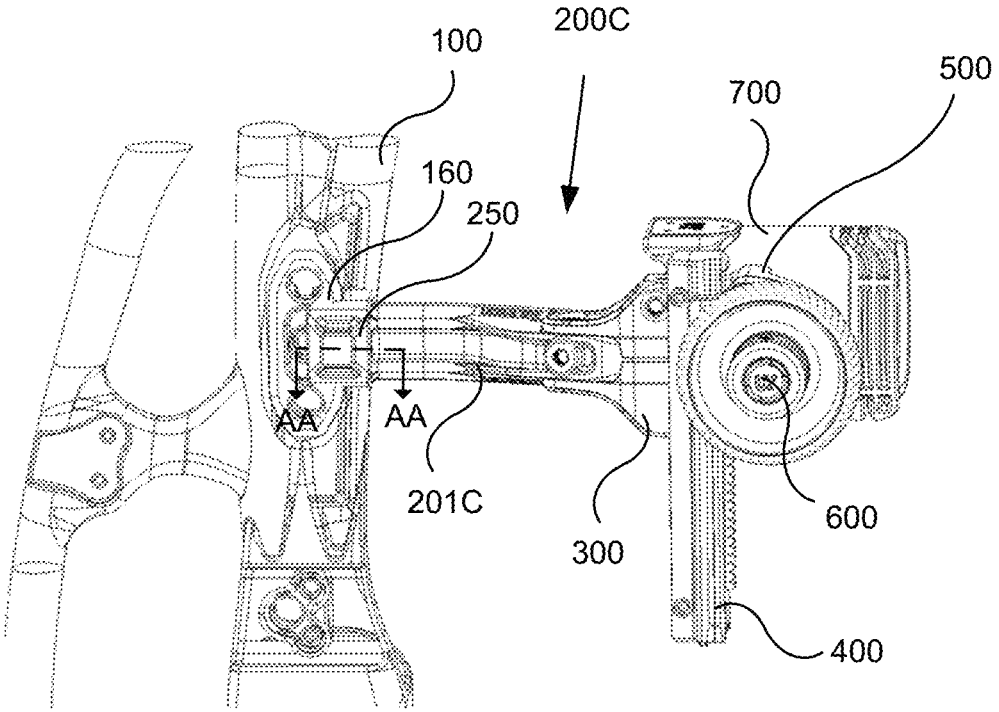
FIG. 7A is a side view of a bow, support structure, and bow sight, according to an example of the present disclosure.
Figure 7B:
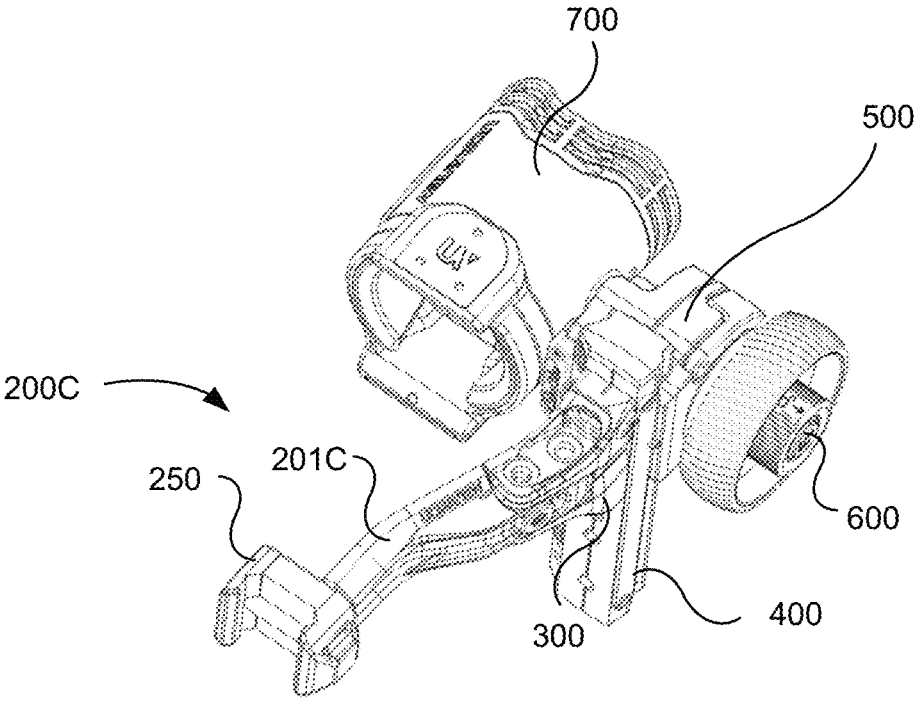
FIG. 7B is a top perspective view of the bow, support structure, and bow sight of FIG. 7A, according to an example of the present disclosure.
Figure 8:
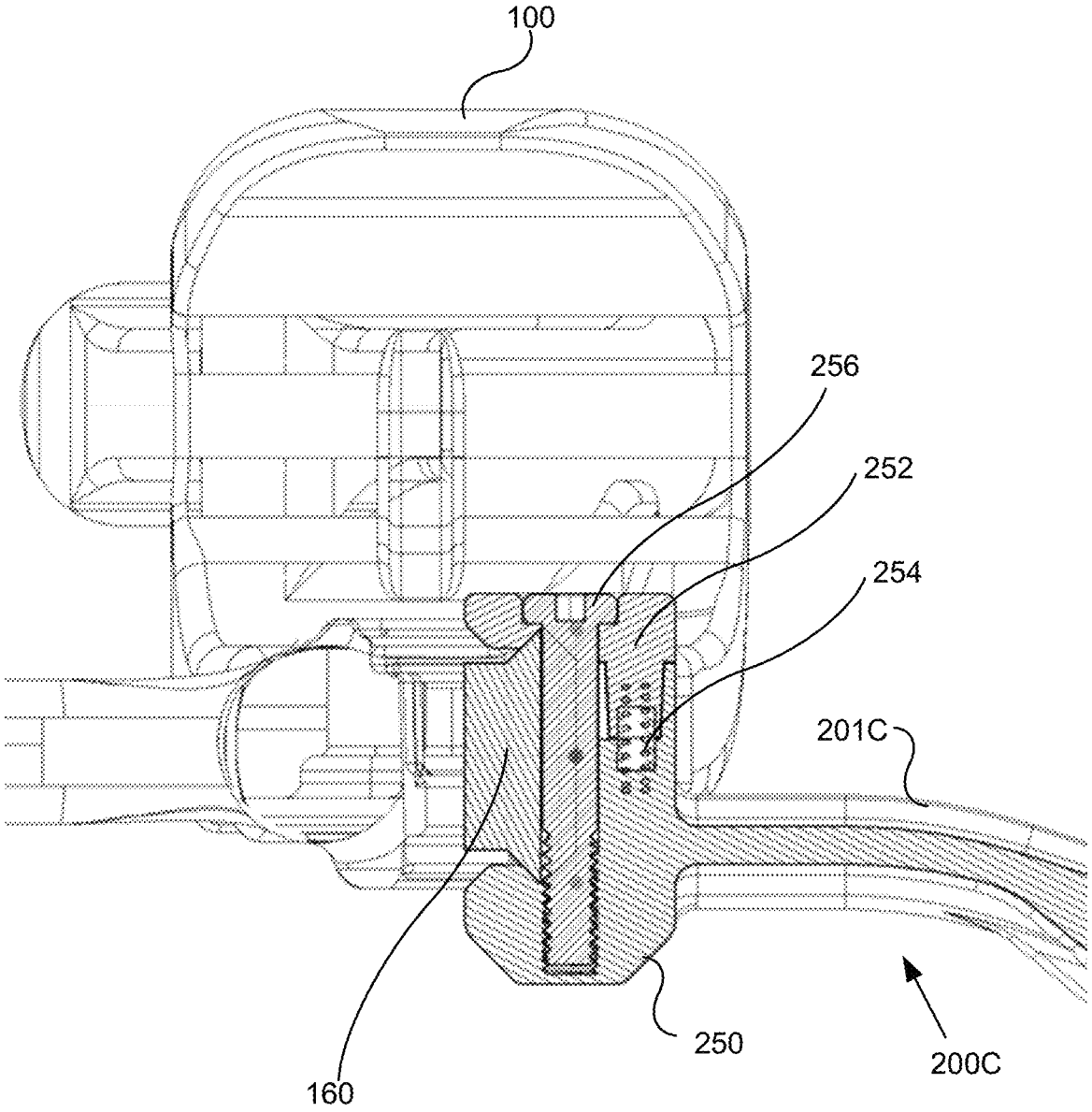
FIG. 8 is a cross-sectional view of the Picatinny rail mount taken along line AA-AA in FIG. 7A, according to an example of the present disclosure.

Turning now to FIGS. 7A-8, a third example rail assembly 200C is shown and described. The rail assembly 200C can include a rail 201C and a Picatinny rail mount 250. The Picatinny rail mount 250 can be configured to attach to a Picatinny rail 160 that can be mounted on a bow 100. As shown in FIG. 8, which is a cross-sectional view of the Picatinny rail mount 250 taken along line AA-AA in FIG. 7A, the Picatinny rail mount 250 can include a fastener 256, a clamping block 252, and a spring 254 configured. The fastener 256, clamping block 252, and spring 254 can be configured to clamp the Picatinny rail mount 250 to the Picatinny rail 160 at predetermined locations. In this way, the height position of the bow sight 700 can be set when attached to the bow 100. The Picatinny rail mount 250 can be configured such that a user can release and adjust the position of the Picatinny rail mount 250 on the Picatinny rail 160 with one hand which can provide for easier adjustment of the position of the bow sight 700 on the bow 100.

Figure 9:
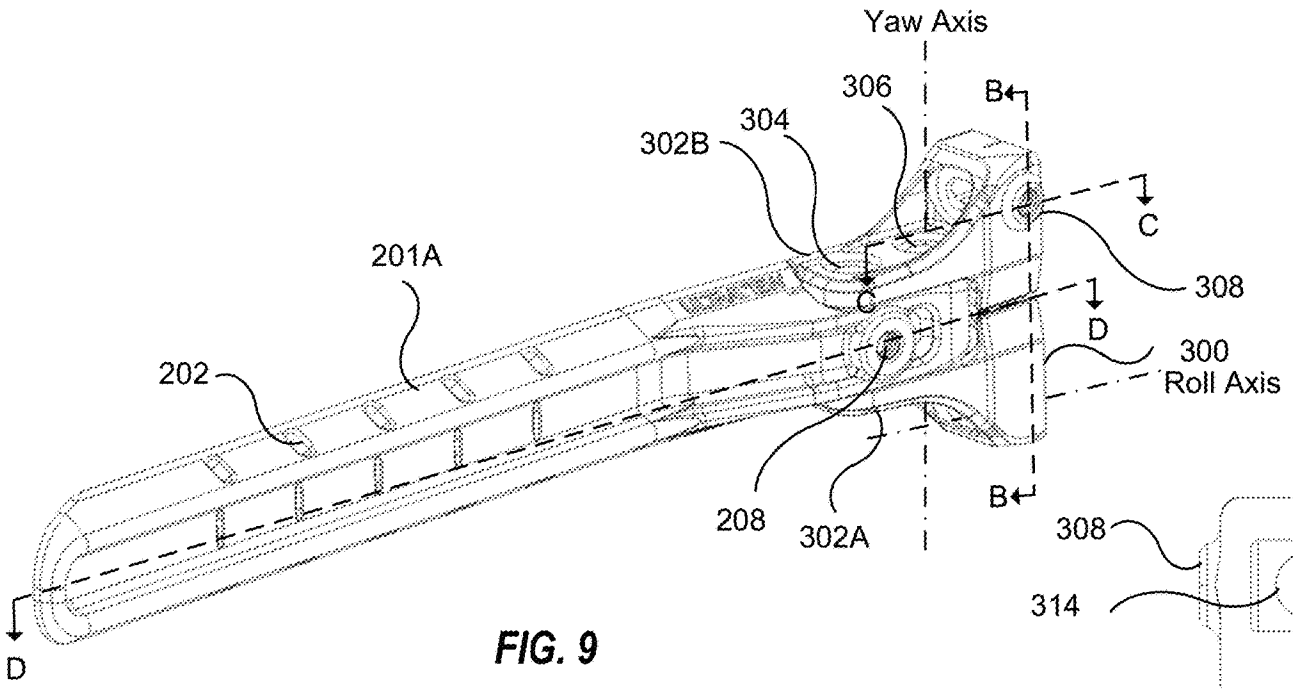
FIG. 9 is a perspective view of a rail and a yaw block, according to an example of the present disclosure.
Figure 10:
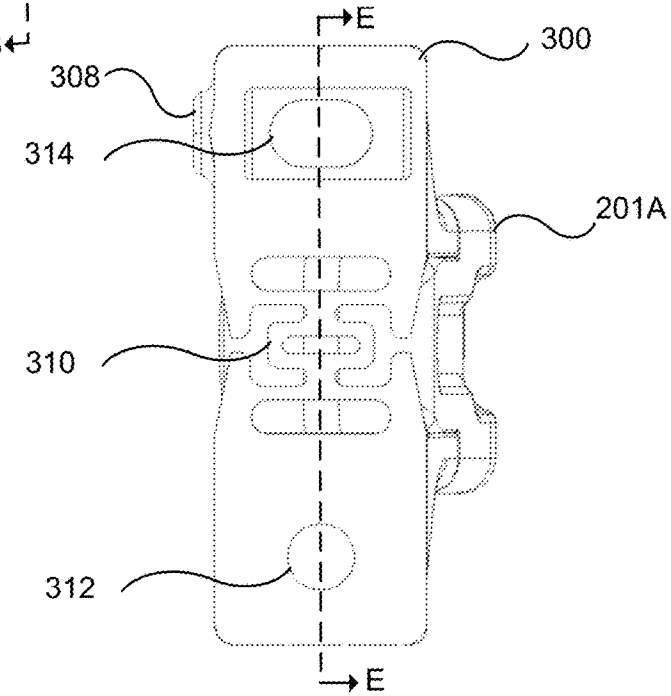
FIG. 10 is a rear view of the rail and yaw block, according to an example of the present disclosure.

FIG. 9 is a perspective view of a rail assembly 200A and a yaw block 300, according to an example of the present disclosure. As shown, the rail assembly 200A (or 200B or 200C) can be attached to the yaw block 300. The yaw block 300 can include a cutout pattern forming an expansion joint 310 (as shown in FIG. 10) that can enable the yaw block 300 to expand and contract with a parallel clamping force (as opposed to a cantilevered clamping force) which can help to ensure the rail assembly 200A is sufficiently clamped in the yaw block 300 to prevent movement between the rail assembly 200A and the yaw block 300. The expansion joint 310 can be configured to permit a lower support 302A and an upper support 302B to move toward and away from each other while also remaining generally parallel to each other to ensure sufficient clamping force. The expansion joint 310 is shown having a particular pattern of material removed from the yaw block 300, however, it will be appreciated that other shapes of material can be removed from the yaw block 300 to form the expansion joint 310.

The yaw block 300 can be configured to adjust a position of the bow sight 700 about a roll axis and a yaw axis (as shown in FIG. 9). The roll axis can be an axis that extends through the yaw block 300 that is generally parallel to an axis passing through a center of the bow sight 700 in a direction with the shooting line of the bow 100. The yaw axis can be an axis that extends through the yaw block 300 that is generally perpendicular to an axis passing through the center of the bow sight 700 in a direction with the shooting line of the bow 100 (e.g., a vertical axis).

Figure 12:
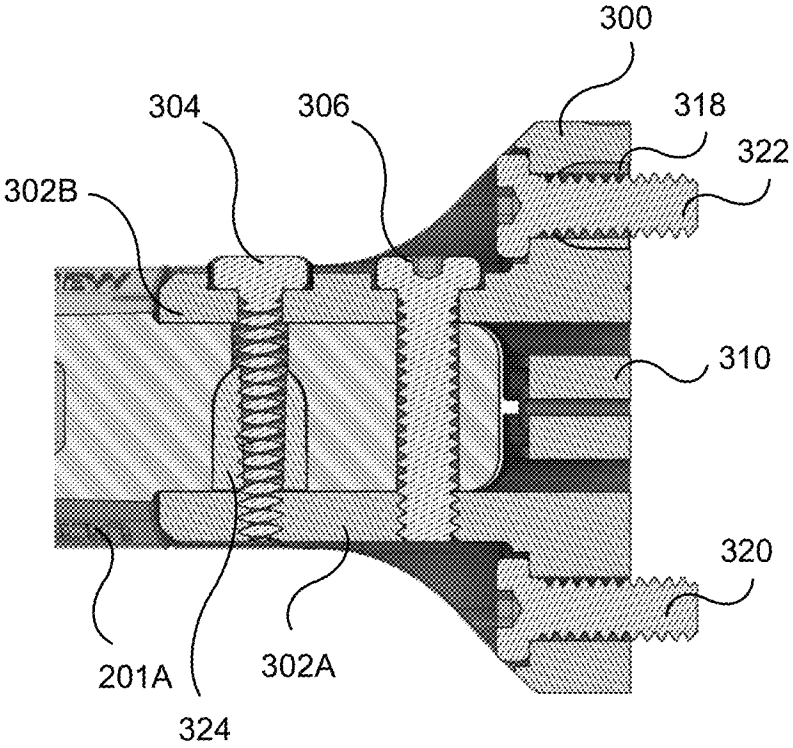
FIG. 12 is a section view of the yaw block taken along line E-E of FIG. 10, according to an example of the present disclosure.
Figure 11:
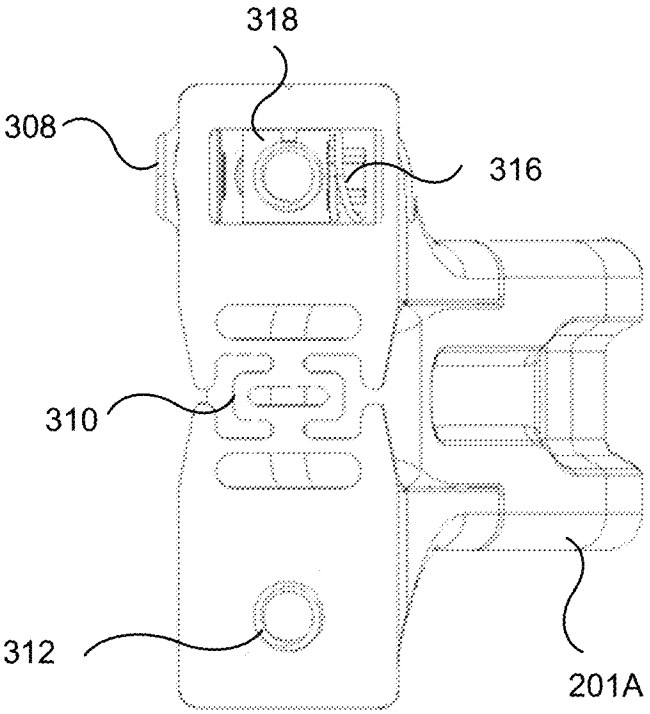
FIG. 11 is a section view of the yaw block taken along line B-B of FIG. 9, according to an example of the present disclosure.

As shown in FIGS. 11 and 12, a first roll aperture 312 and a second roll aperture 314 can extend through the yaw block 300 as a position above and below the rail 201A. The first roll aperture 312 can be sized to receive a first roll fastener 320 while the second roll aperture 314 can be a slot configured to receive a second roll fastener 322 while leaving room to permit the second roll fastener 322 to slide along the second roll aperture 314. The first roll fastener 320 can be configured to act as a pivot point and the first roll fastener 322 can be configured to adjust a position of the sight 700 about the roll axis.

As shown in FIG. 11, which is a section view of the yaw block 300 and the rail assembly 200A taken along line B-B of FIG. 9, a roll spacer 318 can be positioned in the yaw block 300 and the second roll fastener 322 can extend through the roll spacer 318. This feature is also shown in FIG. 12, which is a section view of the yaw block 300 and the rail assembly 200A taken along line E-E of FIG. 10, as well as FIG. 13, which is a section view of the yaw block 300 taken along line C-C of FIG. 9. The roll spacer 318 can be a simple block, nut, or other piece of material through which the second roll fastener 322 can extend. As shown in FIG. 11, the roll spacer 318 can be positioned in the yaw block 300 with a spring 316 that can apply a lateral force perpendicular to the roll axis. The spring 316 can help to keep the yaw block in place in relation to rack 400. A roll set screw 308 can extend through the rail yaw block 300 and be configured to push on the roll spacer 318 and the second roll fastener 322. By applying the lateral force on the roll spacer 318 and the second roll fastener 322, the yaw block 300 can be caused to rotate about the first roll fastener 320 which helps to define the roll axis. Adjusting the position of the yaw roll set screw 308, the yaw block 300 will be caused to rotate about the first roll fastener 320, thereby causing the bow sight 700 to rotate about the roll axis.

Returning now to FIG. 9, a first yaw fastener 304 and a second yaw fastener 306 can each extend through the upper support 302B, the rail assembly 200A (or 200B or 200C), and the lower support 302A to secure the yaw block 300 to the rail assembly 200A (or 200B or 200C). As the first yaw fastener 304 and the second yaw fastener 306 are tightened, the compression joint 310 can permit the upper support 302B and the lower support 302A to move toward each other to clamp the yaw block 300 onto the rail 201A. The second yaw fastener 306 can be configured to act as a pivot point and the first yaw fastener 304 can be configured to adjust a position of the sight 700 about the yaw axis.

As shown in FIG. 12, which is a section view of the yaw block 300 and the rail assembly 200A taken along line E-E of FIG. 10, a yaw spacer 324 can be positioned in the rail assembly 200A and the first yaw fastener 304 can extend through the yaw spacer 324. The yaw spacer 324 can be a simple block, nut, or other piece of material through which the first yaw fastener 304 can extend. As shown in FIG. 14, which is a section view of the rail assembly 200A and the yaw block 300 taken along line D-D of FIG. 9, the yaw spacer 324 can be positioned in the rail 201A with a spring 326 that can apply a lateral force perpendicular to the yaw axis. The spring 326 can help to keep the rail 201A in place in relation to the yaw block 300 when making adjustments. A yaw set screw 208 can extend through the rail 201A and be configured to push on the yaw spacer 324 and the first yaw fastener 304. By applying the lateral force on the yaw spacer 324 and the first yaw fastener 304, the yaw block 300 can be caused to rotate about the second yaw fastener 306 which helps to define the yaw axis. Adjusting the position of the yaw set screw 208, the yaw block 300 will be caused to rotate about the second yaw fastener 306, thereby causing the bow sight 700 to rotate about the yaw axis.

Figure 15:
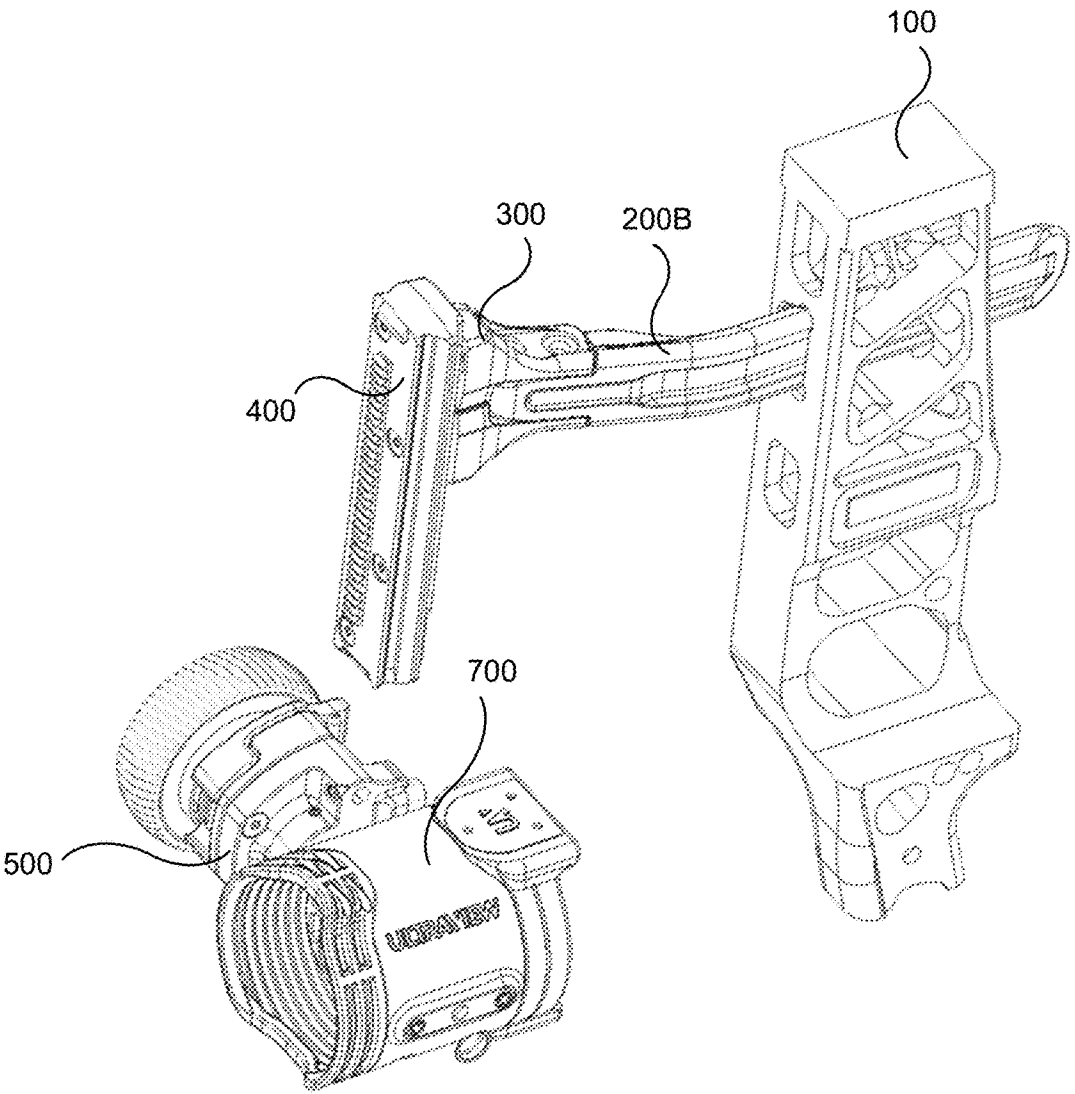
FIG. 15 is a partially exploded view of the bow, support structure, and bow sight of FIGS. 3-6, according to an example of the present disclosure.

FIG. 15 is a partially exploded view of the bow 100, support structure 200, 300, 400, 500, and 600, and bow sight 700 of FIGS. 3-6, according to an example of the present disclosure. As shown in FIG. 15, the elevation assembly 500 can be configured to detach from the rack 400 to easily remove the bow sight 700 from the bow 100. This can be helpful, for example, for storing, cleaning, moving, or other activities where it could be disadvantageous to keep the bow sight 700 attached to the bow 100.

Figure 16:
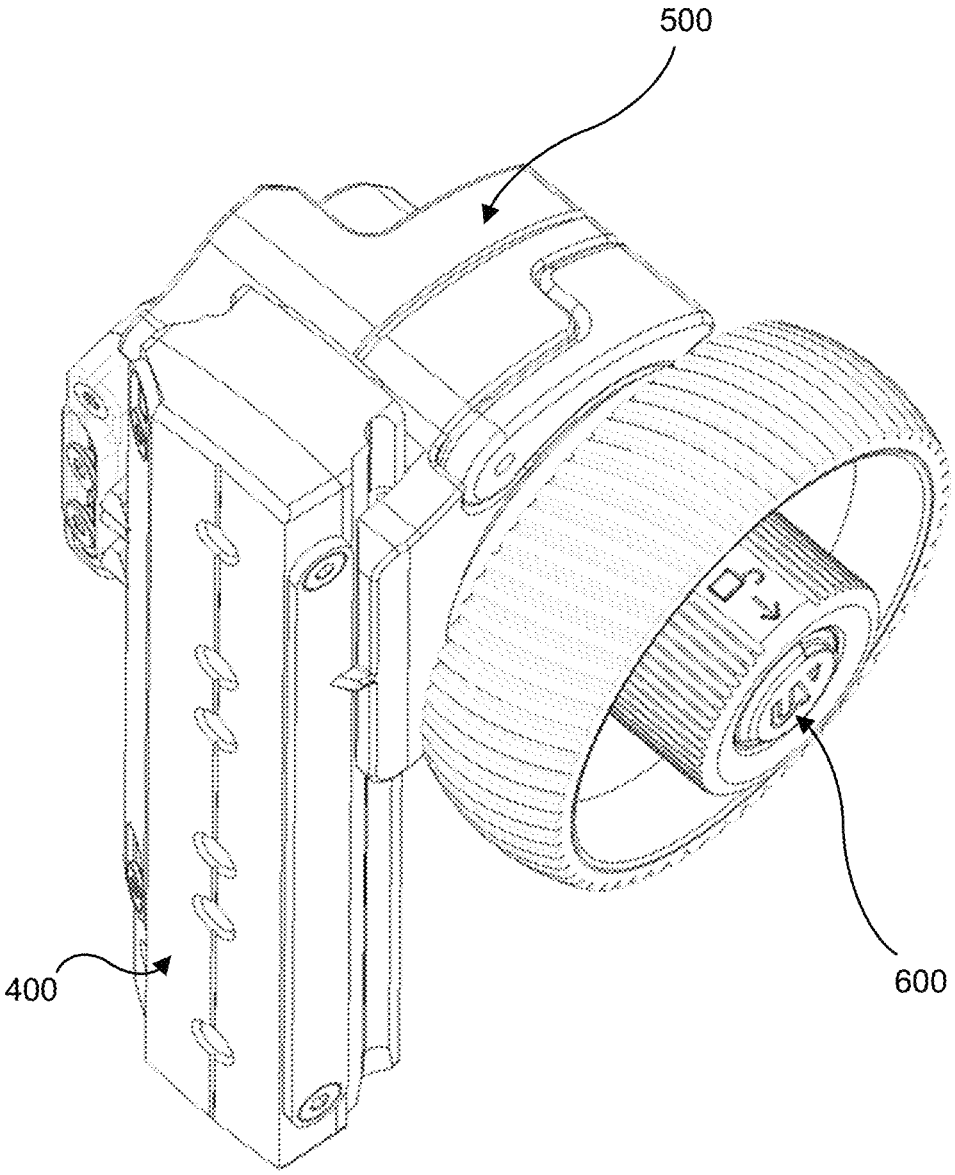
FIG. 16 is a perspective view of a portion of the support structure, according to an example of the present disclosure.

FIG. 16 is a perspective view of a portion of the support structure, according to an example of the present disclosure. As shown in FIG. 16, the rack can be attached to the elevation assembly 500 and the windage assembly 600. As will become apparent throughout this disclosure, the elevation assembly 500 can be configured to slide along the rack 400 to permit movement of the bow sight 700 in a direction generally perpendicular in a first direction (e.g., vertically) to an axis passing through the bow sight 700 that is parallel to the shooting line. In other words, the elevation assembly 500 can be configured to move the bow sight 700 along an elevation direction. Furthermore, the windage assembly 600 can be configured to slide along the elevation assembly 500 to permit movement of the bow sight 700 in a direction generally perpendicular in a second direction (e.g., horizontally) to an axis passing through the bow sight 700 that is parallel to the shooting line. In other words, the windage assembly 600 can be configured to move the bow sight 700 along a windage direction.

Figure 18:
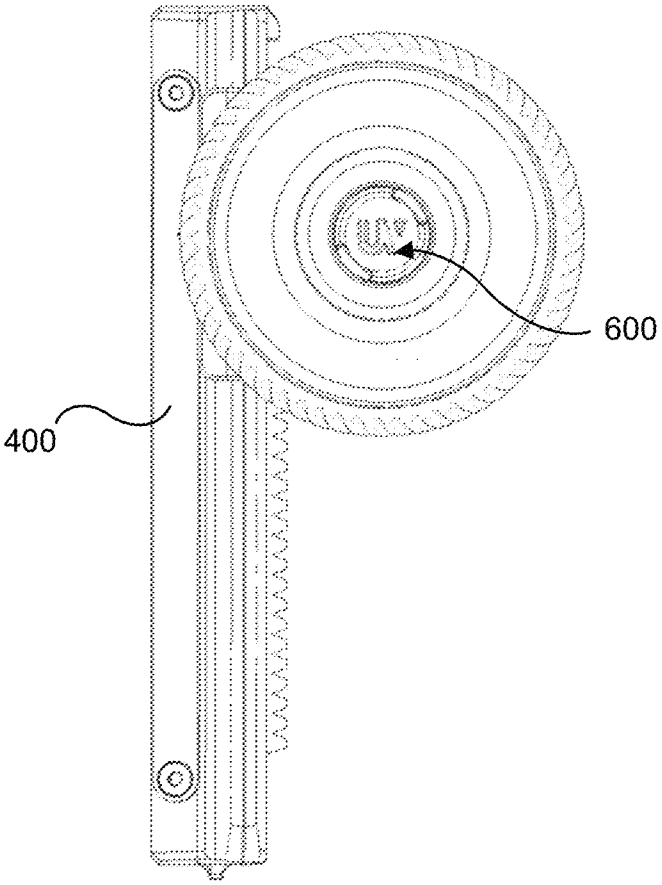
FIG. 18 is a side view of a portion of the support structure, according to an example of the present disclosure.
Figure 17:
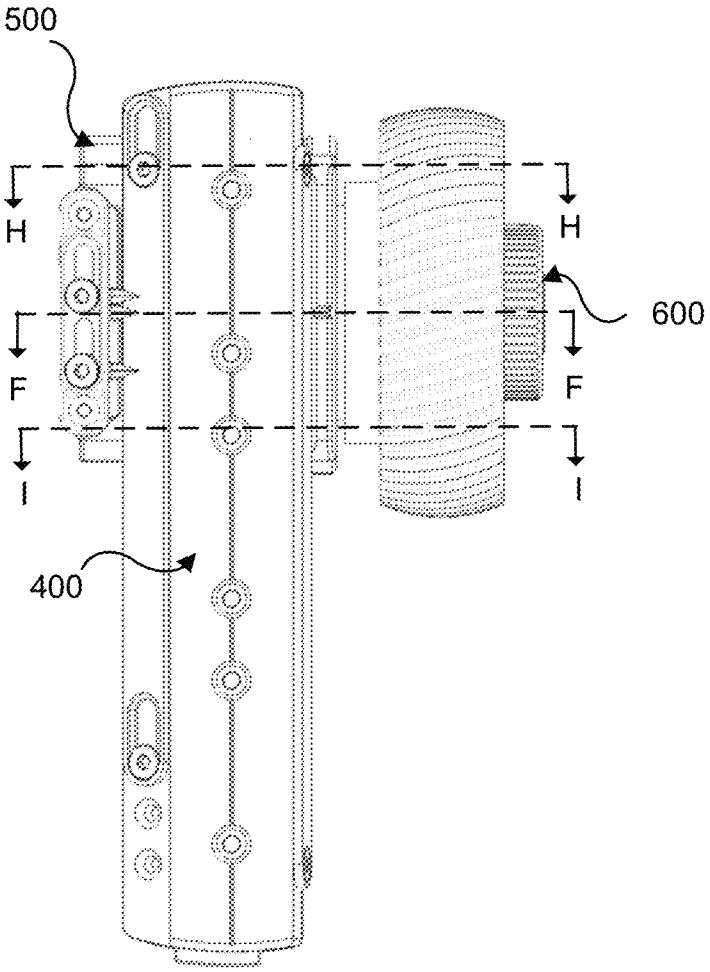
FIG. 17 is a front view of a portion of the support structure, according to an example of the present disclosure.
Figure 20:
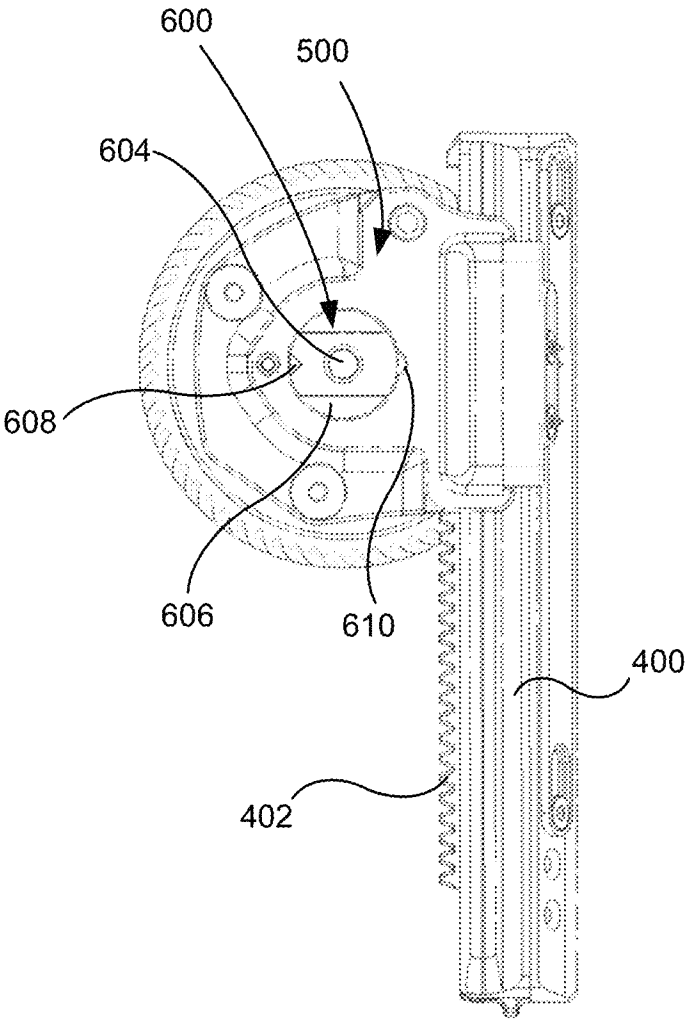
FIG. 20 is another side view of a portion of the support structure, according to an example of the present disclosure.
Figure 19:
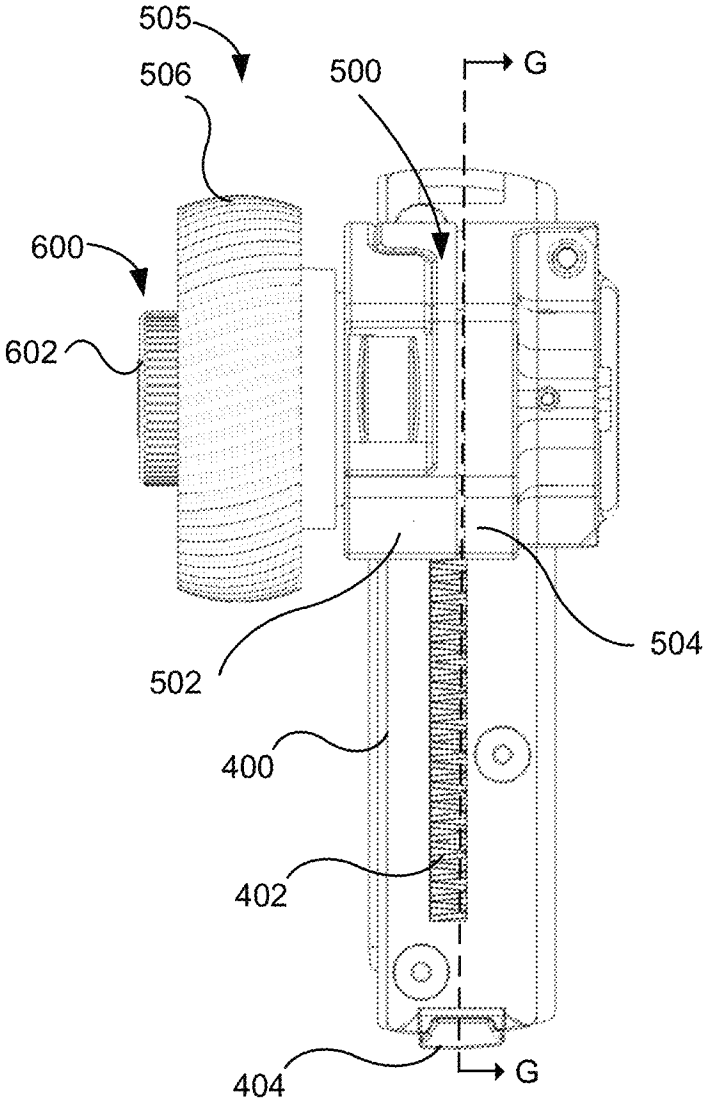
FIG. 19 is a rear view of a portion of the support structure, according to an example of the present disclosure.
Figure 21:
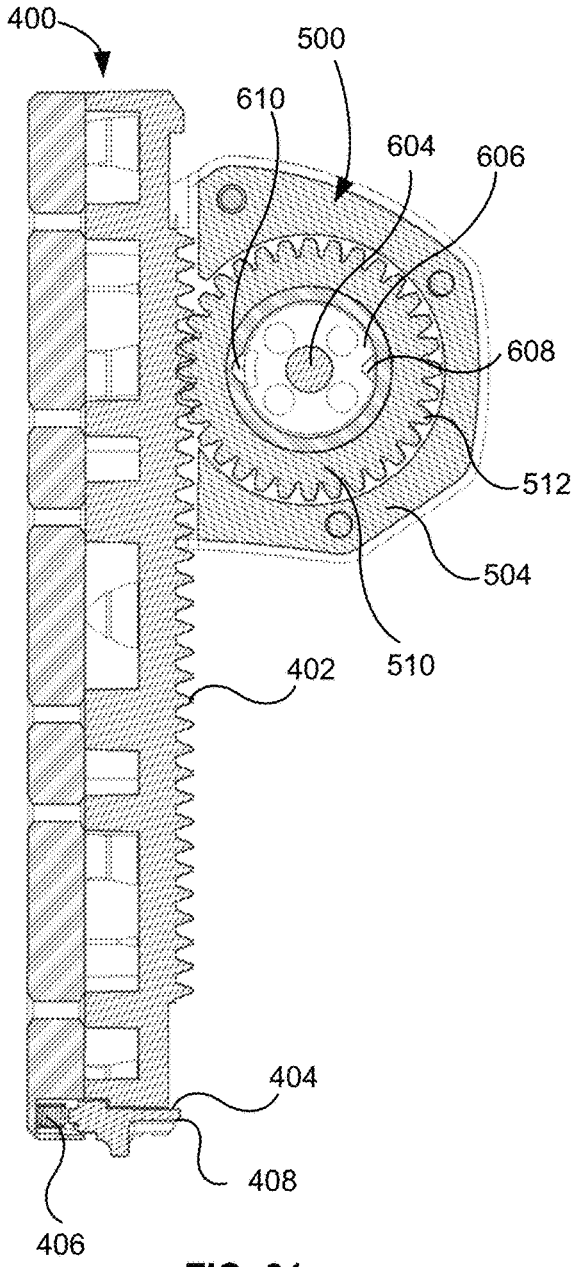
FIGS. 21 and 22 are section views of a portion of the support structure taken along line G-G of FIG. 19, according to an example of the present disclosure.
Figure 22:
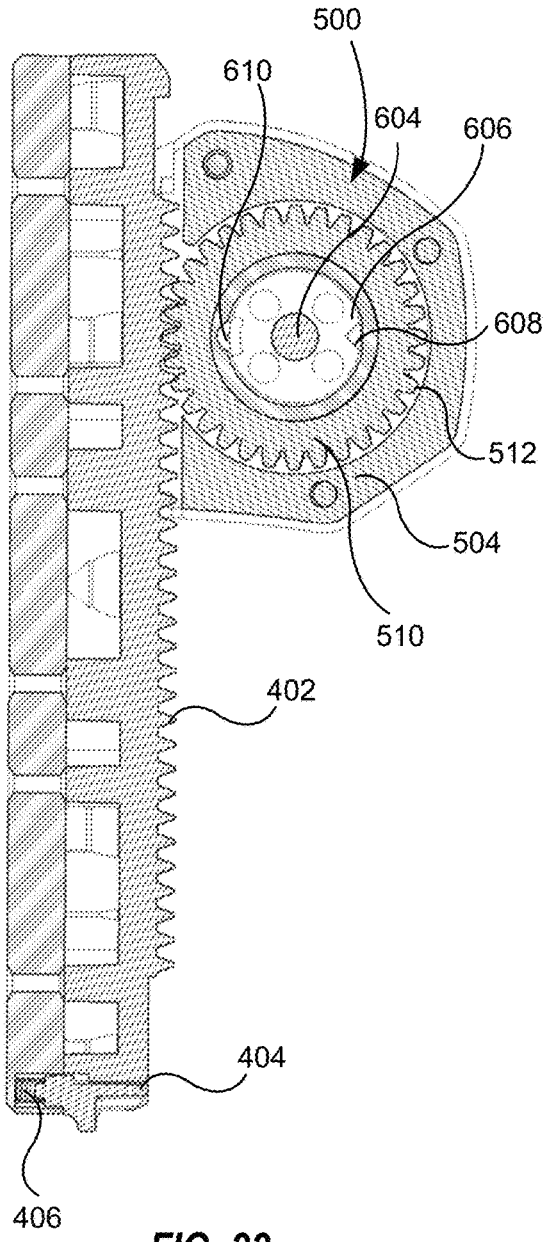

FIG. 17 is a front view, FIG. 18 is a side view of the rack 400, FIG. 19 is a rear view, and FIG. 20 is another side view of the rack 400, the elevation assembly 500, and the windage assembly 600, according to an example of the present disclosure. As shown in FIG. 19, the rack 400 can include rack gear teeth 402 that can extend along at least a portion of the length of the rack 400. The rack 400 can further include a lock member 404 that can be configured to transition between a locked (as shown in FIG. 21) and an unlocked position (as shown in FIG. 22). As shown in FIGS. 21 and 22, which are cross sectional views of the rack 400, the elevation assembly 500, and the windage assembly 600 taken along line G-G of FIG. 19, the lock member 404 can include a spring 406 that can cause the lock member 404 to normally be in a locked position in which the elevation assembly 500 is prevented from being removed from the rack 400. When the lock member 404 is pushed inwardly, the lock member 404 can be moved out of the way of the elevation assembly 500 and the elevation assembly can be moved along the rack 400 until it can be removed from the rack 400.

The lock member 404 can include an angled edge 408 that can be configured to permit the elevation assembly 500 to be pushed onto the rack 400 without manually moving the lock member 404 to the unlocked position. In other words, a user can install the elevation assembly 500 onto the rack 400 without needing to push down on the lock member 404 to move it out of the way because the angled edge 408 will contact the elevation assembly 500 and the elevation assembly 500 will cause the lock member 404 to move out of the way. The lock member 404 can be a latch or other component configured to move between a locked and an unlocked position to permit the elevation assembly 500 to be easily installed and removed from the rack 400.

Returning now to FIG. 19, the elevation assembly 500 can include a first housing 502 and a second housing 504 that can be two separate components connected together to attach the elevation assembly 500 onto the rack 400. As will be explained in greater detail in relation to FIG. 29, the first housing 502 and the second housing 504 can be configured to hold internal components and attach the elevation assembly 500 to the rack 400. The elevation assembly 500 can further include an elevation actuator 505 that can be actuated to move the elevation assembly 500 along the rack 400. The elevation actuator 505 can be a wheel (as shown in FIG. 19), a tri-lobe handle, a multi-lobe handle, or any other shape that can be gripped and actuated by a user. Thus, although the elevation actuator 505 is shown as a wheel, one of skill in the art will appreciate that other shapes can be used without departing from the scope of this disclosure.

As shown in FIGS. 21 and 22, the elevation assembly 500 can further include a pinion gear 510 having pinion gear teeth 512. The pinion gear 510 can be attached to the elevation actuator 505 and the pinion gear teeth 512 can be configured to engage the rack gear teeth 402. Thus, when a user actuates the elevation actuator 505, the elevation gear teeth 512 can engage the rack gear teeth 402 and cause the elevation assembly 500 to move along the rack 400 in the elevation direction.

Figure 23:
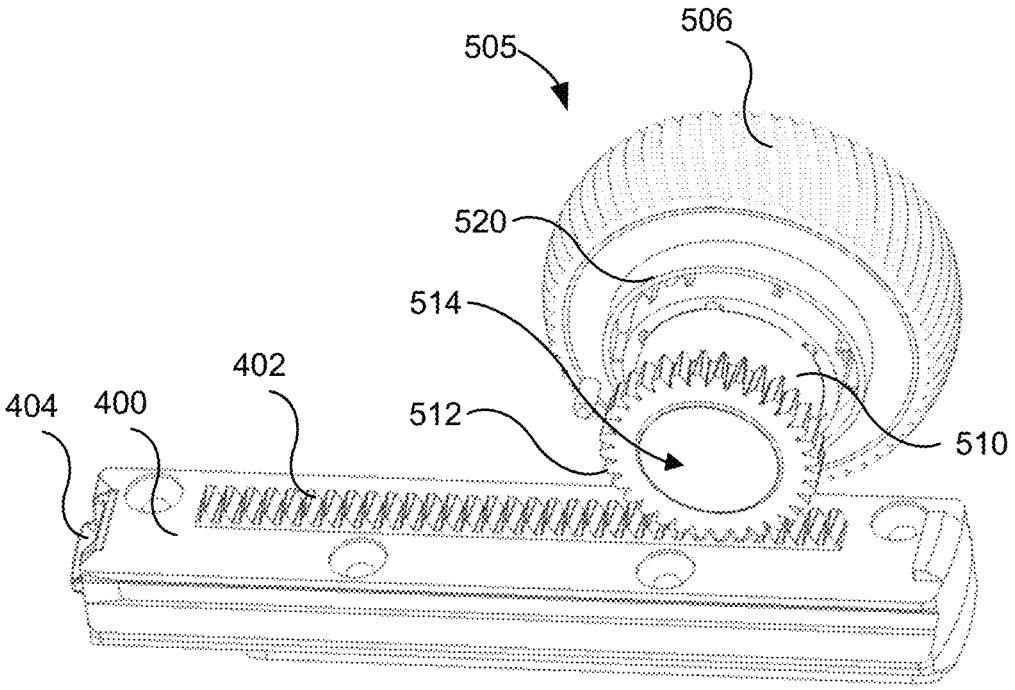
FIGS. 23 and 24 are partial assembly views of an elevation assembly, according to an example of the present disclosure.
Figure 24:
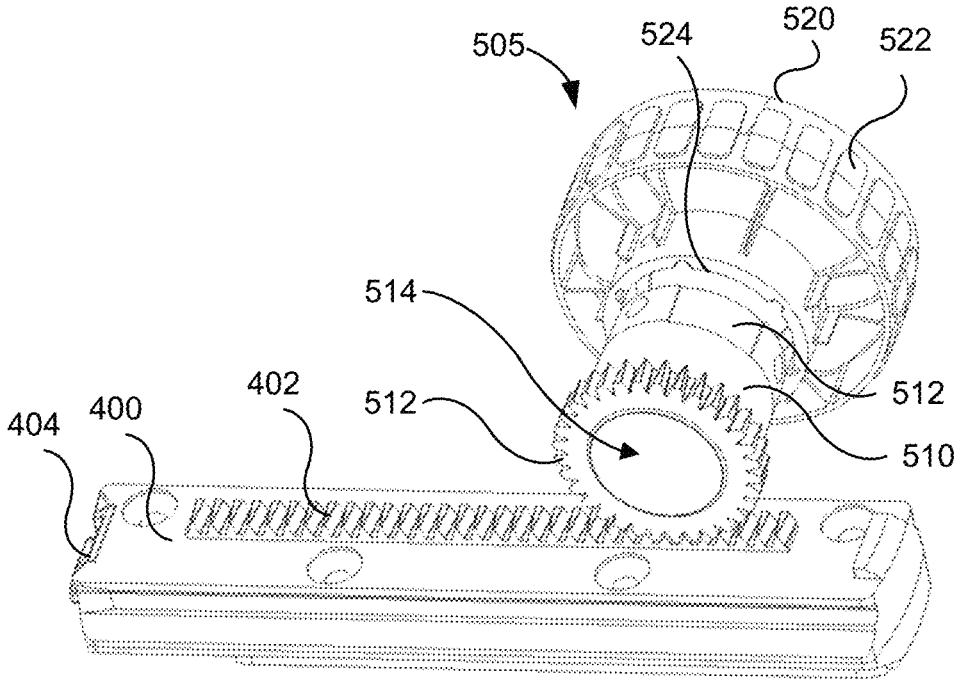

FIGS. 23 and 24 illustrate the pinion gear teeth 512 engaging the rack gear teeth 402. FIG. 23 illustrates the elevation actuator 505 having a rubber or otherwise textured grip 506 while FIG. 24 shows the grip 506 removed. As shown the elevation actuator 505 can further include a windage wheel 520 that can be disposed between the grip and the pinion gear 510. The grip 506 can be configured to engage with one or more ridges 522 or other features formed into a windage wheel 520 to ensure the grip 506 is prevented from sliding along the windage wheel 520 when the elevation actuator 505 is actuated. The grip 506 can be configured to be removed and changed out with other types of grips such that a user can select a preferred type of grip 506.

The windage wheel 520 can have a protrusion 524 configured to engage with a recess 512 of the pinion gear 510. In this way, the windage wheel 520 can be configured to transfer a rotational force applied to the grip 506 (and the windage wheel 520) when the elevation actuator 505 is actuated. In other examples, the windage wheel 520 can have a recess and the pinion gear 510 can have a protrusion or each can have a combination of protrusions and recesses such that the windage wheel 520 is keyed to the pinion gear 510. In some examples, the windage wheel 520 and the pinion gear 510 can form a spline joint to ensure the windage wheel 520 is sufficiently engaged with the pinion gear 510. For example, the recess 512 and the protrusion 524 can each extend at corresponding angles such that as the windage wheel 520 is pushed on to the pinion gear 510, the adapter 510 and pinion gear 520 can create a friction fit to ensure the windage wheel 520 and pinion gear 510 are sufficiently engaged with each other.

Figure 25:
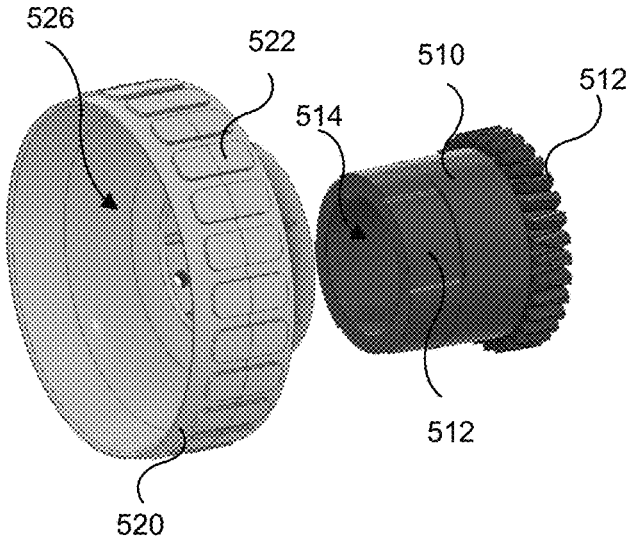
FIGS. 25 and 26 are exploded views of a wheel and pinion gear of the elevation assembly, according to an example of the present disclosure.
Figure 26:
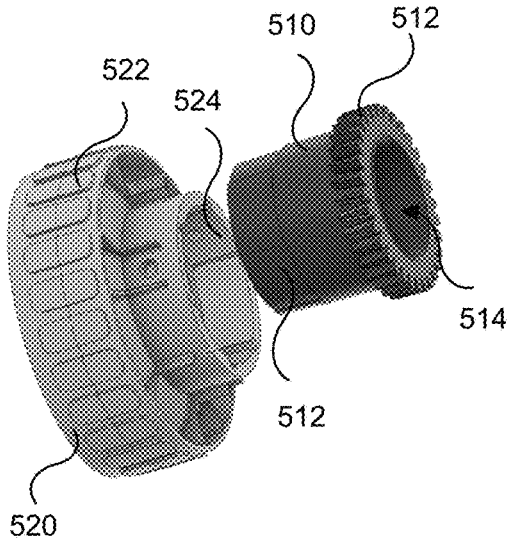
Figure 27:
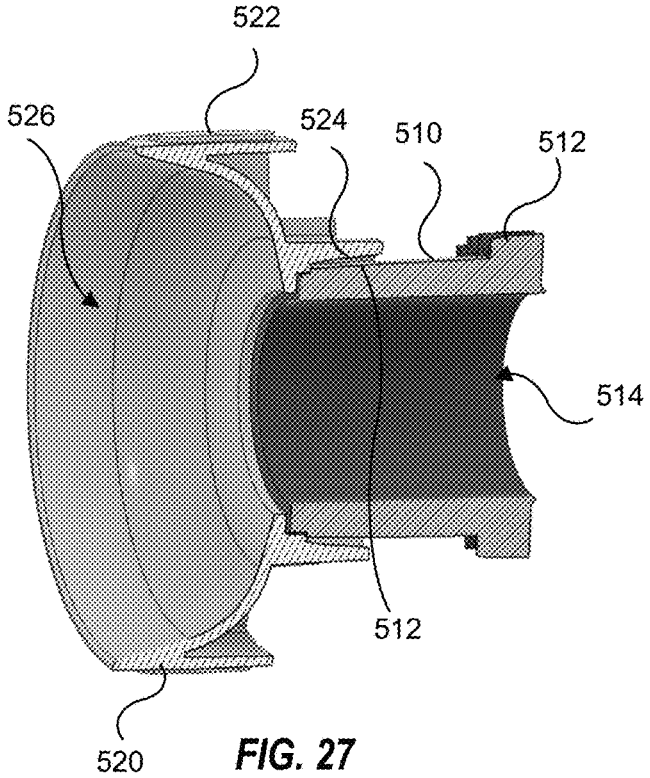
FIG. 27 is a section view the wheel and pinion gear shown in FIGS. 25 and 26 taken along a center line of the wheel and pinion gear, according to an example of the present disclosure.
Figure 28:
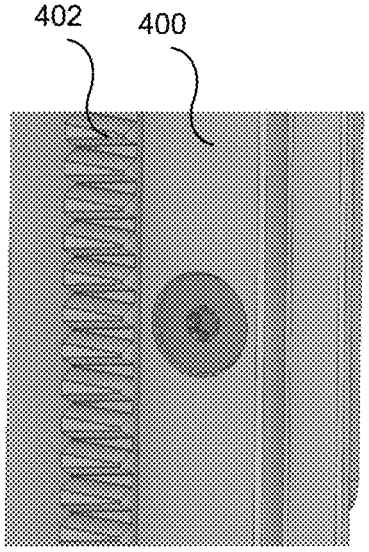
FIG. 28 is a detail view of a rack gear, according to an example of the present disclosure.

As shown in FIGS. 23-28, the rack gear teeth 402 (shown best in FIG. 28) and the pinion gear teeth 512 can be angled. By having angled rack gear teeth 402 and angled pinion gear teeth 512, the pinion gear teeth 512 can be caused to tightly engage the rack gear teeth 402 to prevent slop and backlash between the gear teeth. The pinion gear teeth 512 that converge toward each other from a first side of the pinion gear 510 to a second side of the pinion gear 510 as seen in FIGS. 25 and 26. Similarly, the rack gear teeth 402 that converge toward each other from a second side of the rack 400 to a first side of the rack 400, the first side of the pinion gear 510 can correspond to the first side of the rack 400 and the second side of the pinion gear 510 can correspond to the second side of the rack 400.

The pinion gear teeth 512 can be pushed against the rack gear teeth 402 by a first resilient member 530 and/or a second resilient member 532. The first and second resilient members 530, 532 can be components configured to apply a force to the pinion gear 510 in a direction perpendicular to the elevation direction. In this way, the angled pinion gear teeth 512 can be sprung against the angled rack gear teeth 402 so that the mesh can adapt over the length of the rack 400 (or the length of the rack 400 having rack gear teeth 402) and allow the gear teeth to be preloaded against each other. This can help to ensure the elevation assembly 500 is caused to move smoothly along the rack 400 in the elevation direction.

Figure 29:
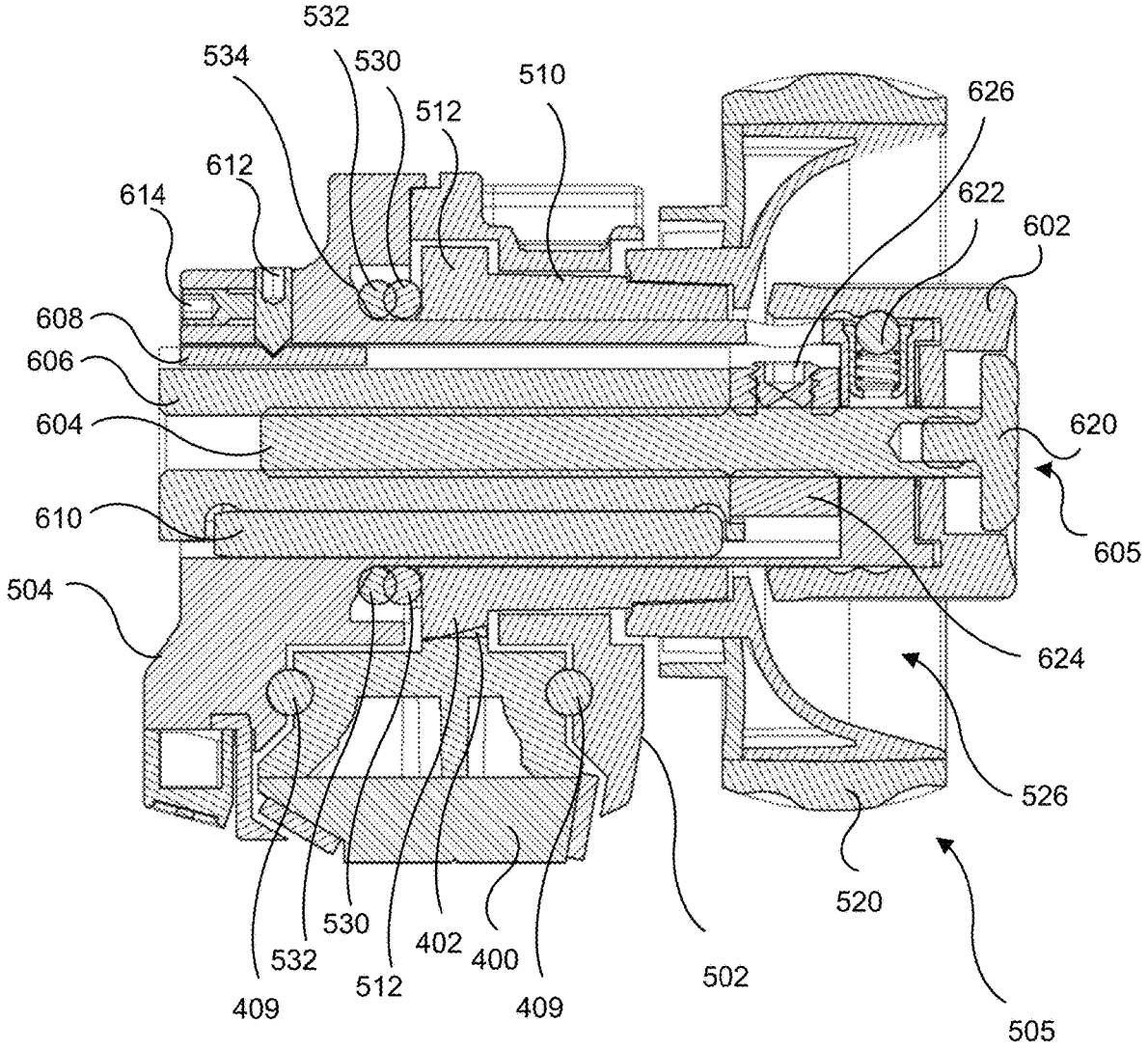
FIG. 29 is a section view of an elevation assembly and windage assembly taken along line F-F of FIG. 17, according to an example of the present disclosure.

The first and second resilient members 530, 532 can be, for example, one or more O-rings that are stretched over a ramped surface 534 formed into the second housing 504 of the elevation assembly (as shown in FIG. 29). As will be appreciated, by stretching an O-ring over a ramped surface 534, the resilient O-ring will naturally want to move along the ramped surface back to its normal, unstretched state. The O-ring will then push against the pinion gear 510 and cause it to move until the pinion gear teeth 512 engage the rack gear teeth 402. In some examples, the first resilient member 530 can be a rigid material while the second resilient member 532 can be a flexible material, and vice versa. In this way, one of the first and second resilient members 530, 532 can act as an anvil while the other applies a spring force against the anvil. Furthermore, the first resilient member 530 can have a different durometer than the second resilient member 532 to achieve a desired force applied to the pinion gear 510. In other examples, the first and second resilient members 530, 532 can be springs or other resilient components that will cause a reactive force with placed under compression or tension.

Turning now to FIG. 29, which is a cross-sectional view of the rack 400, the elevation assembly 500, and the windage assembly 600 taken along line F-F of FIG. 17 and showing how the elevation assembly 500 can be attached to the rack 400. As shown, the first housing 502 and the second housing 504 of the elevation assembly 500 can be disposed on opposite sides of the rack 400 and configured to extend at least partially around the rack 400. One or more guide pins 409 can be disposed between the elevation assembly 500. The guide pins 409 can be disposed at least partially in tracks formed into sides of the first housing 502, second housing 504, and either side of the rack 400. The tracks can be recesses formed into the respective components and configured to receive the guide pins 409 such that, when the first housing 502 and the second housing 504 are assembled together and installed on the rack 400, the guide pins 409, in combination with the recesses, permit the elevation assembly 500 to move along the elevation direction but prevent the elevation assembly 500 from being pulled away from the rack 400 in any other direction.

Figure 33:
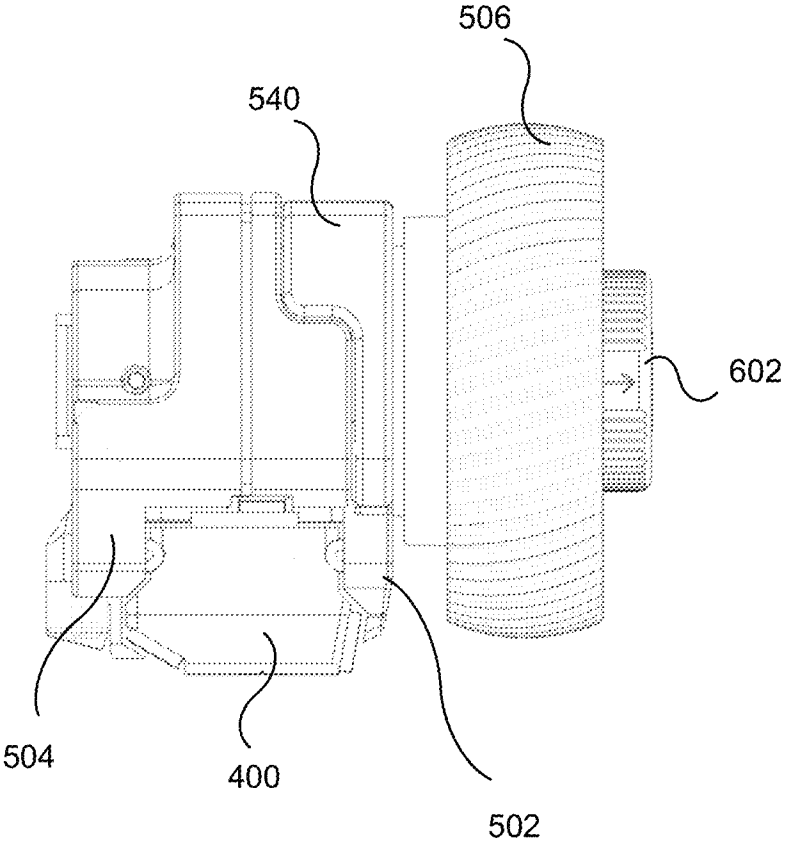
FIG. 33 is a top view of an elevation assembly and a windage assembly, according to an example of the present disclosure.
Figure 35:
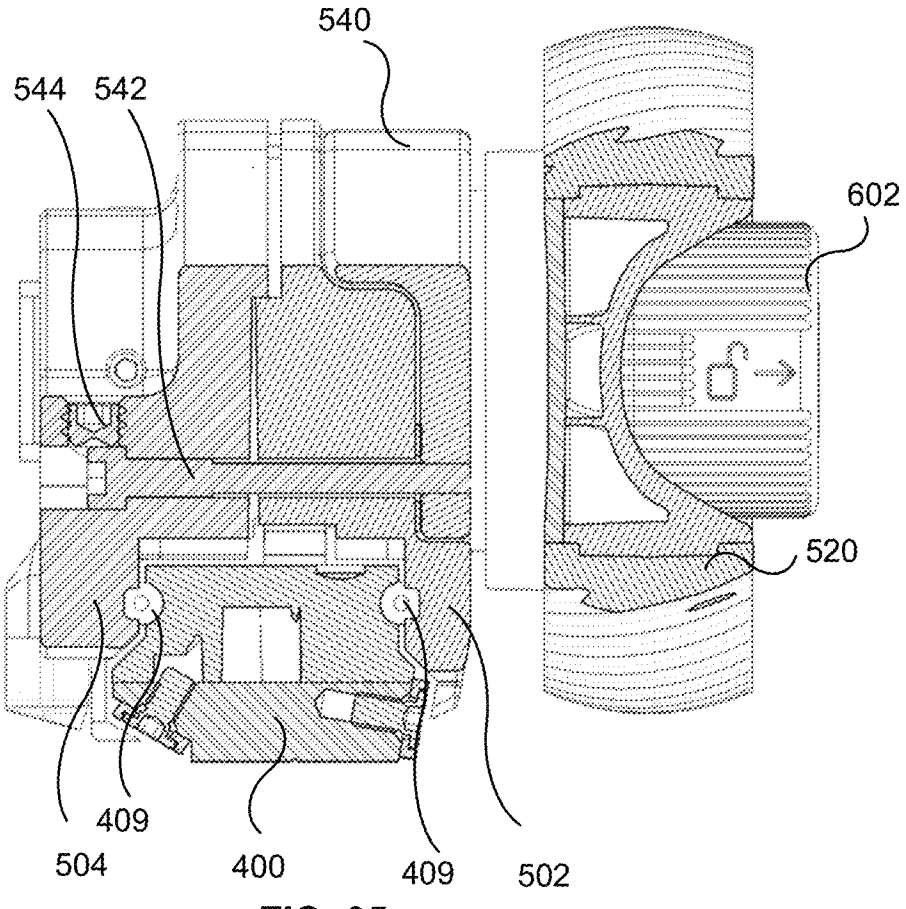
FIG. 35 is a section view of an elevation assembly and a windage assembly taken along line H-H of FIG. 17, according to an example of the present disclosure.

The disclosed technology can include a lock lever 540, as shown in FIGS. 33 and 35, that can be configured to transition between a locked and an unlocked position. The lock lever 540 can be attached to the elevation assembly 500 by a by a lock lever fastener 542 (as shown in FIG. 35, which is a cross-sectional view of the elevation assembly 500 and rack 400 taken along line H-H of FIG. 17) that can extend through the first housing 502 and the second housing 504. The lock lever 540 can act as a nut that will tighten or loosen depending on which direction the lock lever 540 is turned along the lock lever fastener 542. The lock lever fastener 542 can be kept in place by a separate set screw 544 that can be configured to contact a head of the lock lever fastener 542. The lock lever 540 can be configured to tighten the first and second housings 502, 504 together when the lock lever 542 is moved toward the first housing 502 and to loosen first and second housings 502, 504 when the lock lever 542 is moved away from the first housing 502.

The lock lever fastener 542 can be set at a predetermined tension when initially assembled such that when a user lifts the lock lever 540 to an unlocked position, the first housing 502 and the second housing 504 loosen and the elevation assembly 500 is able to move along the rack 400 in the elevation direction and when then lock lever is 540 pushed down to the lock position, the first housing 502 and the second housing 504 tighten against the rack 400 and the elevation assembly 500 is prevented from moving along the rack 400 in the elevation direction. The predetermined tension can be set such that the elevation assembly 500 is prevented from moving along the rack 400 in the elevation direction by a gravitational force but a user can still cause the elevation assembly 500 to move along the elevation direction if the user turns the elevation actuator 505 firmly. Stated otherwise, the lock lever 540 can be configured to prevent the elevation assembly 500 from moving along the elevation direction by forces applied to the elevation assembly 500 not by the elevation actuator 505.

Figure 36:
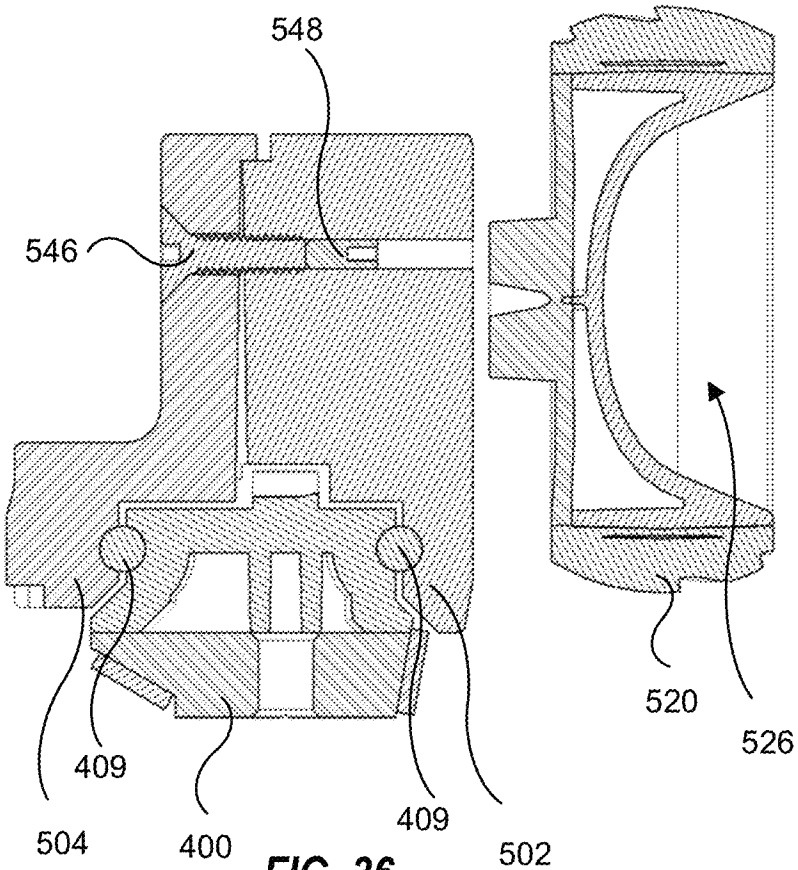
FIG. 36 is a section view of an elevation assembly and a windage assembly taken along line I-I of FIG. 17, according to an example of the present disclosure.

Turning now to FIG. 36, which is a cross-sectional view of the elevation assembly 500 and rack 400 taken along line I-I of FIG. 17, the lock lever 540 can be positioned near a first end of the elevation assembly 500 and a housing fastener 546 can be positioned near a second end of the elevation assembly 500. The housing fastener 546 can be tightened to a preset tension that can permit the elevation assembly 500 to slide along the rack 400. When the lock lever 540 is in the locked position, the first end of the elevation assembly 500 can be pinched against the guide pins 409 and the rack 400 to permit the elevation assembly 500 from sliding along the rack 400. The housing fastener 546 can similarly include a housing fastener set screw 548 that can be tightened against the housing fastener 546 to prevent the housing fastener 546 from loosening over time.

Figure 30:
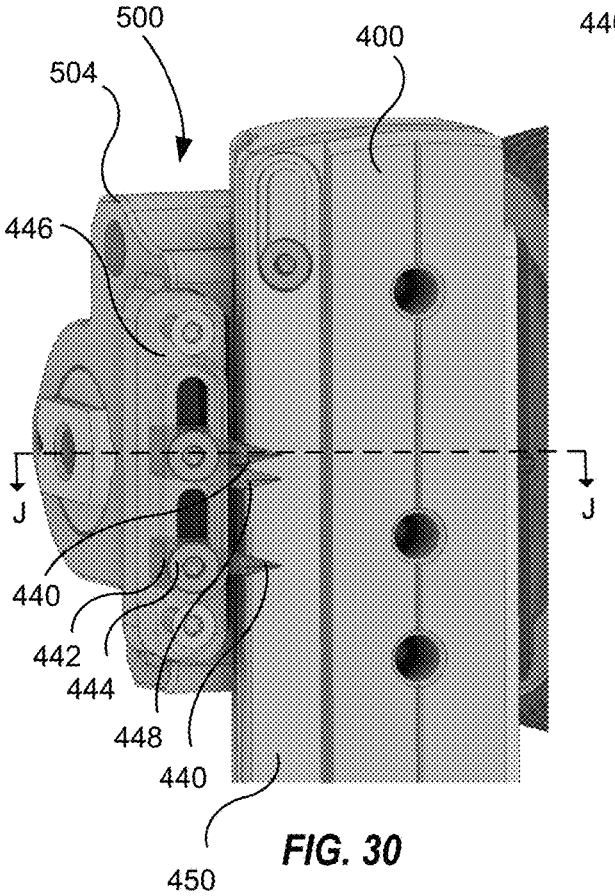
FIG. 30 is a perspective view of an elevation assembly, according to an example of the present disclosure.
Figure 31:
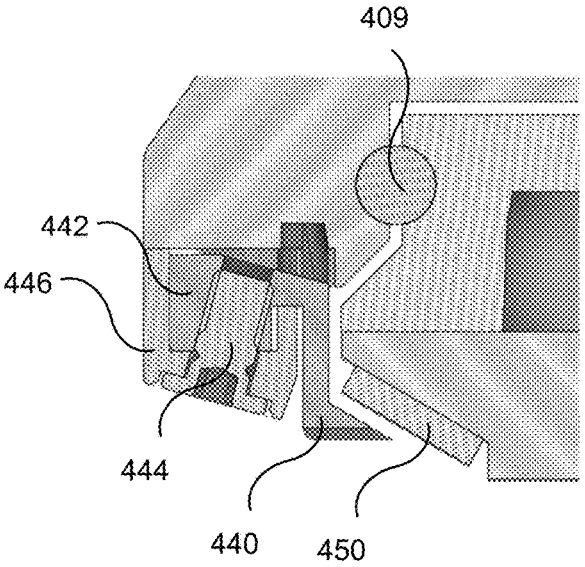
FIG. 31 is a section view of a portion of an elevation assembly taken along line J-J of FIG. 30, according to an example of the present disclosure.

Returning now to FIGS. 30-32, the first housing 502 and the second housing 504 can have one or more indicators disposed thereon that can be configured to align with a first or second sight tape 450, 460 disposed on the rack 400 that can indicate a distance setting of the bow sight 700. For instance, the second housing 504 can include an indicator block 446 (shown as semi-transparent in FIG. 30 for explanatory purposes) that includes a stationary indicator 448 and one or more movable indicators 440 that can be moved along the elevation direction with respect to the indicator block 446. The movable indicators 440 can include a fastener 444 and an indicator nut 442 that can function as both an indicator (e.g., with an arrow or point component) and a nut. As shown in FIG. 31, which is a cross-sectional view of the elevation assembly 500 and the rack 400 taken along line J-J in FIG. 30, the movable indicator 440 and indicator 442 can be one continuous component. When the fastener 444 is tightened with the indicator nut 442, the movable indicator 440 is caused to remain in place. In contrast, when the fastener 444 is loosened with the indicator nut 442, the movable indicator 440 can be moved along the indicator block 446 in the elevation direction. As will be appreciated by one of skill in the art, the indicators 440, 448 can be used by an archer in conjunction with the first sight tape 450 on the rack 400 to adjust the bow sight 700 for various distances to a target.

Figure 32:
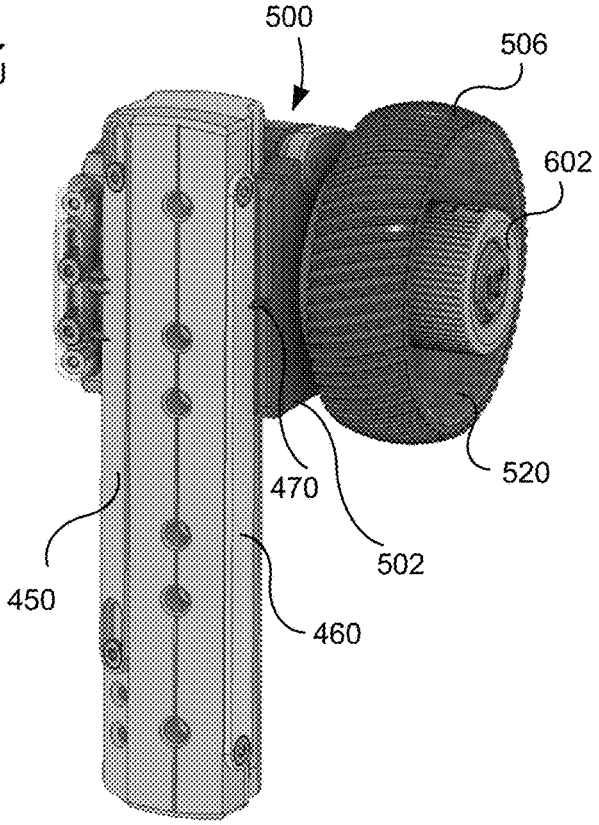
FIG. 32 is another perspective view of an elevation assembly and a windage assembly, according to an example of the present disclosure.
Figure 34:
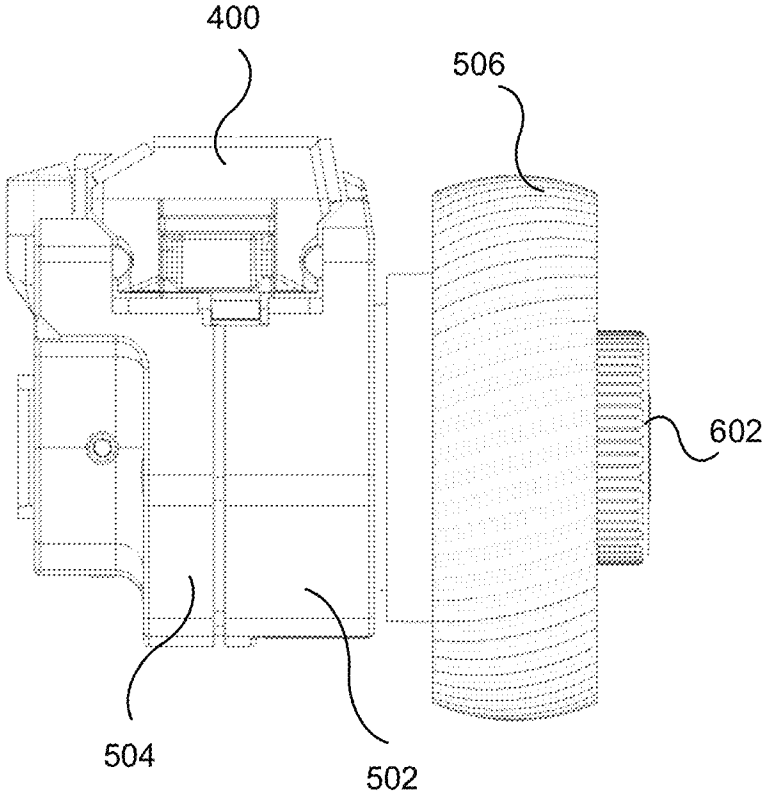
FIG. 34 is a bottom view of an elevation assembly and a windage assembly, according to an example of the present disclosure.

As shown in FIG. 32, the first housing 502 of the elevation assembly 502 can similarly include an indicator 470 and the rack 400 can include a second sight tape 460. The indicator 470 can be stationary and used for making additional adjustments of the bow sight 700 depending on the particular shooting situation. As will be appreciated by one of skill in the art, the indicator 470 can be used by an archer in conjunction with the second sight tape 460 on the rack 400 to adjust the bow sight 700 for various distances to a target.

As shown in FIGS. 23-27, the pinion gear 510 and the windage wheel 520 can have an aperture 514 extending therethrough. The aperture 514 can be sized to receive at least a portion of the windage assembly 600. The windage assembly 600 can comprise a windage actuator 605 (as shown in FIG. 29) that can include a windage wheel 602 that can be attached to a lead screw 604 which is configured to engage with a shaft 606. Windage wheel 602 can be configured to be disposed at least partially in a recess 526 formed into the windage wheel 520 of the elevation assembly 500. In some examples, the elevation actuator 505 can be concentric with the windage actuator 605. In other words, the axis about which the elevation wheel 520 of the elevation actuator 505 rotates can be the same as the axis about the windage wheel 602 of the windage actuator 605 rotates. The recess 526 and the windage wheel 602 can each be sized such that a user can easily place his or her fingers at least partially into the recess 526 to grip the windage wheel 602. The windage wheel 602 can include a textured outer surface such that the windage wheel 602 can be easily gripped by the user.

Figure 37:
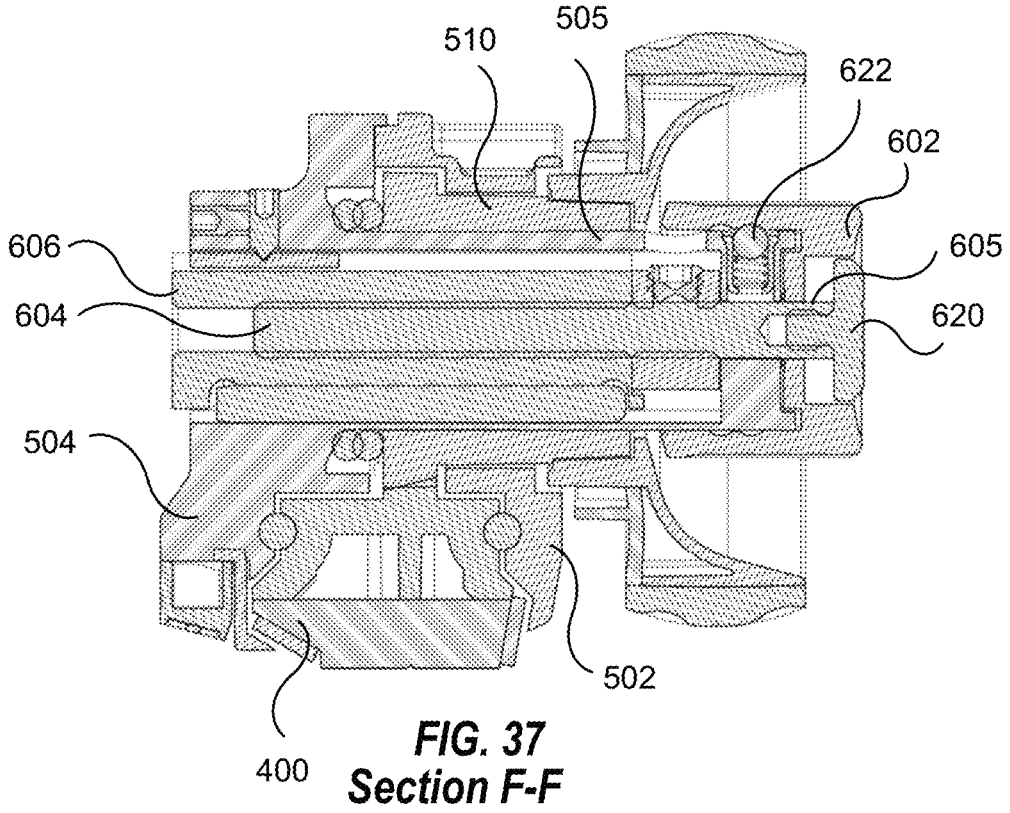
FIG. 37 is a section view of an elevation assembly and a windage assembly in a first position as taken along line F-F of FIG. 17, according to an example of the present disclosure.
Figure 38:
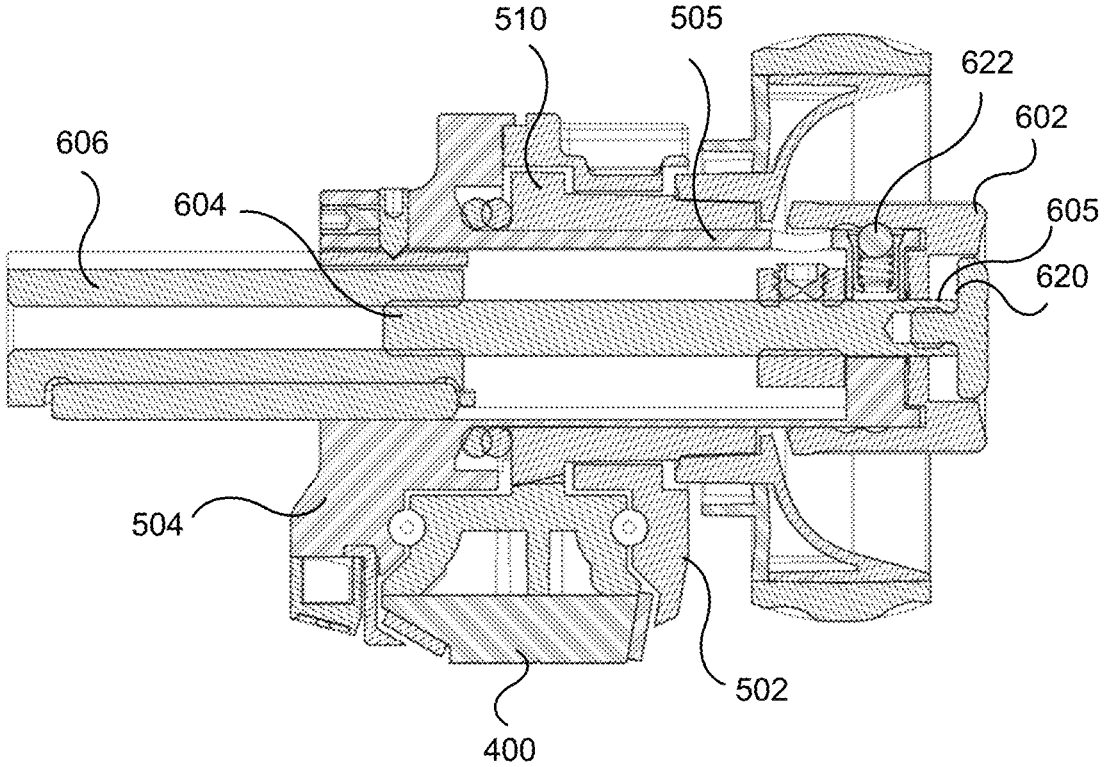
FIG. 38 is a section view of an elevation assembly and a windage assembly in a second position as taken along line F-F of FIG. 17, according to an example of the present disclosure.

As shown in FIGS. 37 and 38, the lead screw 604 can be threaded and configured to cause the shaft 606 to extend along the windage direction when the lead screw 604 is rotated. For example, the shaft 606 can be moved to a first end of a line of travel in the windage direction (as shown in FIG. 37) when the windage wheel 602 is rotated in a first direction and the shaft 606 can be moved to a second end of the line of travel in the windage direction (as shown in FIG. 38) when the windage wheel 602 is rotated in a second direction. To help ensure the lead screw 604 does not slide along the windage direction, a collar 624 can be attached to the lead screw 604 and the collar can be held in place by a collar set screw 626 that can extend through the first housing 502. To help ensure the shaft 606 can be moved in the windage direction when the windage wheel 602 is rotated, the windage assembly 600 can further include a v-block assembly 608 and a guide pin 610 that can prevent the shaft 606 from rotating when the lead screw 604 is rotated (as shown at least in FIGS. 20-22, 29, 37, 38, and 41). In this way, as the lead screw 604 is rotated, the shaft 606 will move along threads of the lead screw 606 and slide along the windage direction instead of simply rotating with the lead screw 606. To help ensure the v-block assembly 608 is held in place, the windage assembly 600 can further include a windage set screw 614 that can extend through the second housing 504 and contact the v-block assembly 612 to keep it in place.

Figure 39:
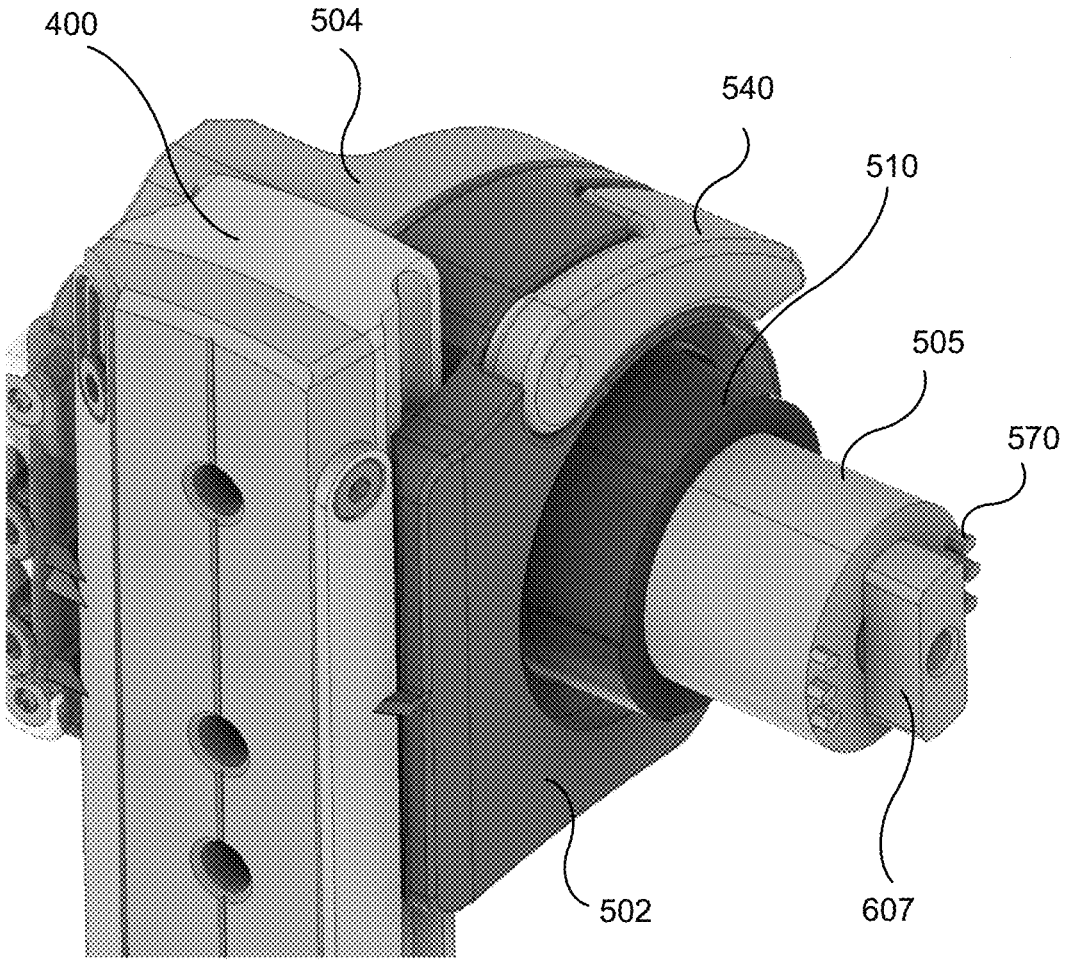
FIG. 39 is a perspective view of a portion of the elevation and windage assemblies, according to an example of the present disclosure.

The lead screw 604 can be keyed to the windage wheel 602 but the windage wheel 602 can be configured to slide along the lead screw 604 between a locked position and an unlocked position. For instance, as shown in FIGS. 39 and 40, the lead screw 604 can include a rectangular end 607 that can extend into the windage wheel 602 and the windage wheel 602 can include a corresponding aperture 609 (as shown in FIG. 43) that is shaped to receive and engage the lead screw 604.

Figure 40:
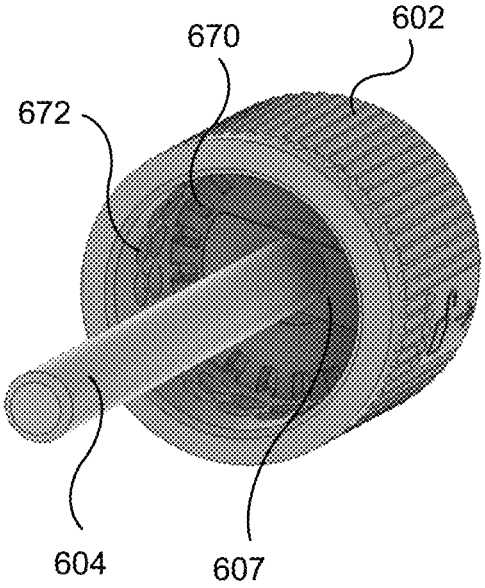
FIG. 40 is a perspective view of a portion of the windage assembly, according to an example of the present disclosure.
Figure 41:
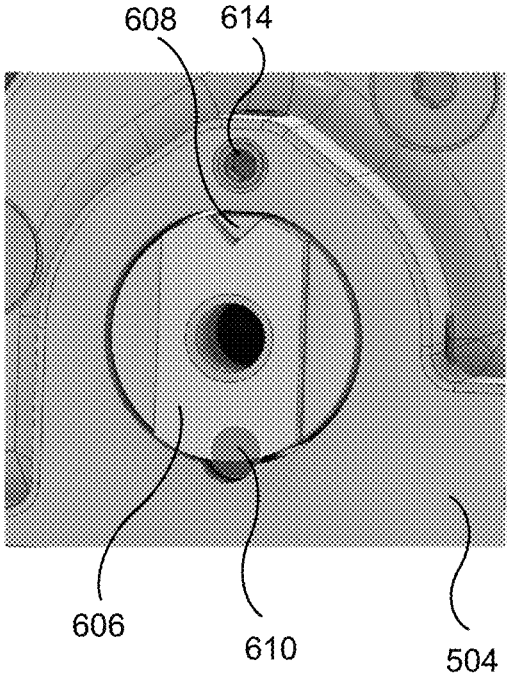
FIG. 41 is a detail view of a portion of the windage assembly, according to an example of the present disclosure.
Figure 42:
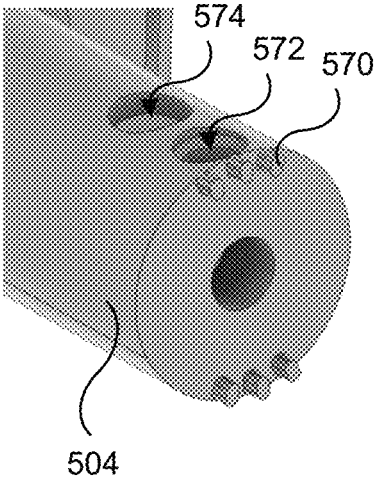
FIG. 42 is a detail view of a portion of the windage assembly, according to an example of the present disclosure.
Figure 43:
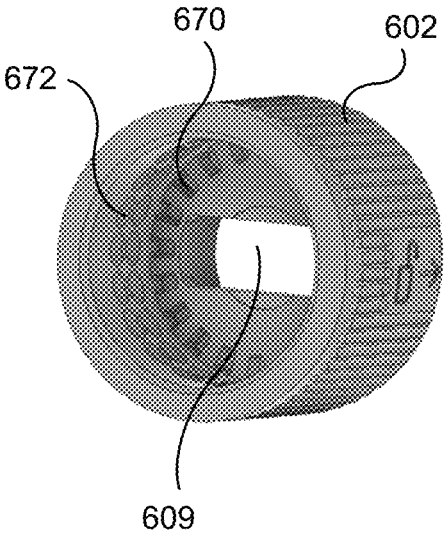
FIG. 43 is a perspective view of a wheel of the windage assembly, according to an example of the present disclosure.

The windage wheel 602 can further include one or more recesses 672 (as shown in FIGS. 40 and 43) that can be configured to receive a detent 622 that extends from the second housing 504 (as shown in FIG. 29). The detent 622 can include a spring-loaded ball that can protrude at least partially from the second housing 504. As shown in FIG. 42, the second housing 504 can include an aperture 572 configured to receive the detent 622. Also shown in FIG. 42 is a set screw aperture 574 configured to receive the collar set screw 626 described above. As the recesses 672 of the windage wheel 602 align with the detent 622, the detent 622 can extend into the recess 672 and maintain the windage wheel 602 in its current position.

As shown in FIGS. 40 and 43, the windage wheel 602 can include at least two rows of recesses 672 that are disposed around an inner circumferential surface of the windage wheel 602. A first row of the recesses 672 can be configured to keep the windage wheel 602 in a locked position while a second row of the recesses 672 can be configured to keep the windage wheel 602 in an unlocked position. In use, the windage wheel 602 can be pulled outwardly by a user to move the windage wheel 602 to an unlocked position. The user can then rotate the windage wheel 602 to move the bow sight 700 to a preferred position and then the user can push the windage wheel 602 back to the locked position to keep the bow sight 700 in place. As will be appreciated, by having recesses 672 disposed around the inner circumferential surface of the windage wheel 602, the detent 622 will protrude into each of the recesses 672 as the windage wheel 602 is turned. This can help provide some feedback to the user as the windage wheel 602 is turned and the windage wheel 602 can be kept in place to ensure the proper windage setting is achieved.

The windage wheel 602 can be prevented from rotating, and thereby moving the shaft 606 in the windage direction, by comprising one or more lock recesses 670 that can be formed into an inner surface of the windage wheel 602. The lock recesses 670 can be configured to align with, and receive, one or more protrusions 570 extending from the second housing 504 (as shown in FIGS. 39 and 42) when the windage wheel 602 is moved to a locked position. When the protrusions 570 extend into the lock recesses 670, the windage wheel 602 will contact the protrusions 570 when the windage wheel 602 is rotated, thereby preventing the windage wheel 602 from rotating. As previously described, the detent 622 and the recesses 672 can help to keep the windage wheel 602 in the locked position.

As will be appreciated, the support structure (200, 300, 400, 500, and 600) for an optical sighting device described herein can be configured such that a user of the bow 100 can adjust the optical sighting device to ensure the bow sight is accurately aligned with a target for a range of distances. Although the disclosed technology is described in relation to a bow sight, it will be appreciated that the support structure (200, 300, 400, 500, and 600) can be configured to support and align various other optical sighting devices such as telescopic sights (scopes), laser sights, reflex sights, collimator sights, prismatic sights, etc. Accordingly, the disclosed technology is not limited to a particular bow sight as described herein. A bow sight 700 that can be used with the disclosed technology, however, is described herein for illustrative purposes.

Figure 45:
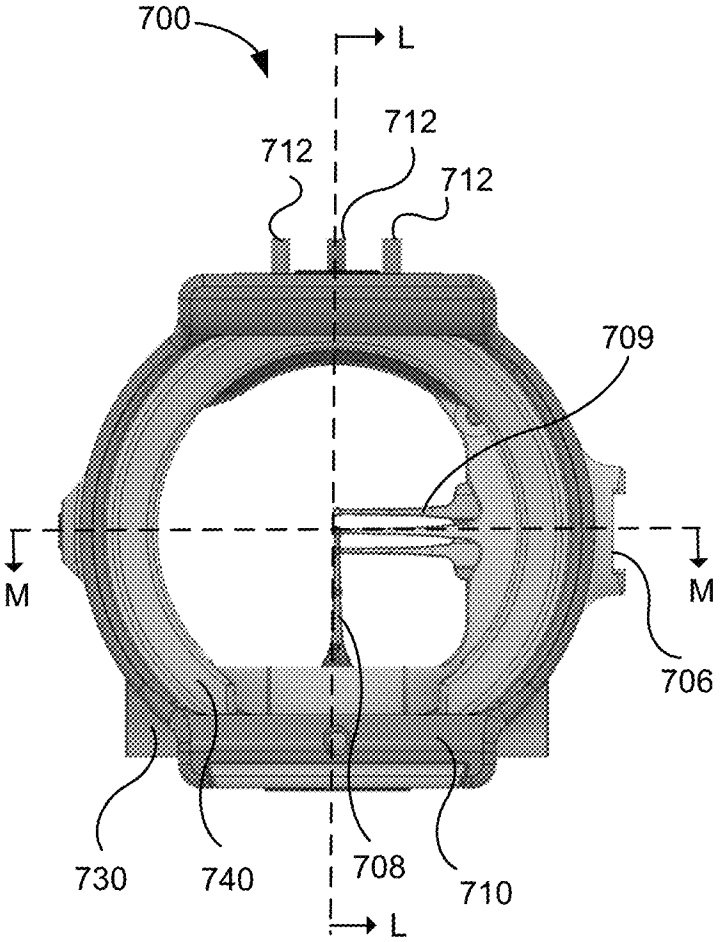
FIG. 45 is a front view of a bow sight, according to an example of the present disclosure.
Figure 44:
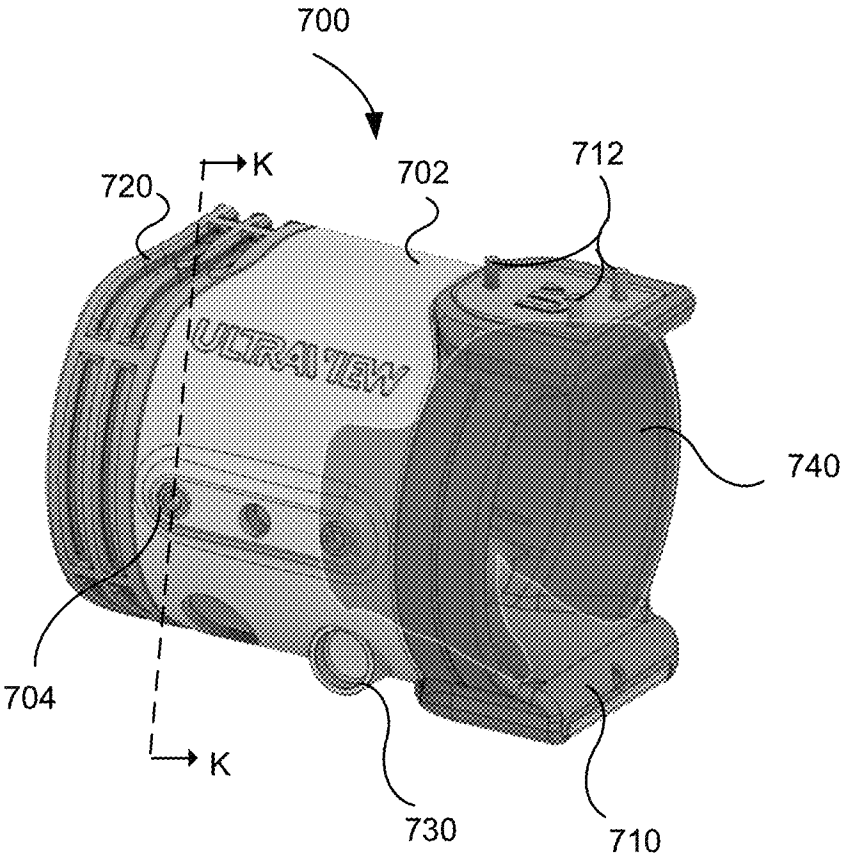
FIG. 44 is a perspective view of a bow sight, according to an example of the present disclosure.

FIG. 44 is a perspective view while FIG. 45 is a front view of a bow sight 700, according to an example of the present disclosure. The bow sight 700 can include a housing 702, a light pack 710, a cartridge assembly 720, a level 730, and an alignment ring 740. The housing 702 and the light pack 710 are shown in FIG. 44 as semi-transparent to illustrate the shape of the alignment ring 740 in the housing 702. The housing 702 can be configured to receive each of the accessories 710, 720, 730, 740 and the accessories 710, 720, 730, 740 can be held in place by a snap fit, magnets, and/or one or more set screws 704 that can extend through the housing 702. Accessories 710, 720, 730, 740 can be designed so that they don't obstruct the field of view of a user while aiming with an assembled bow sight 700.

Figure 51:
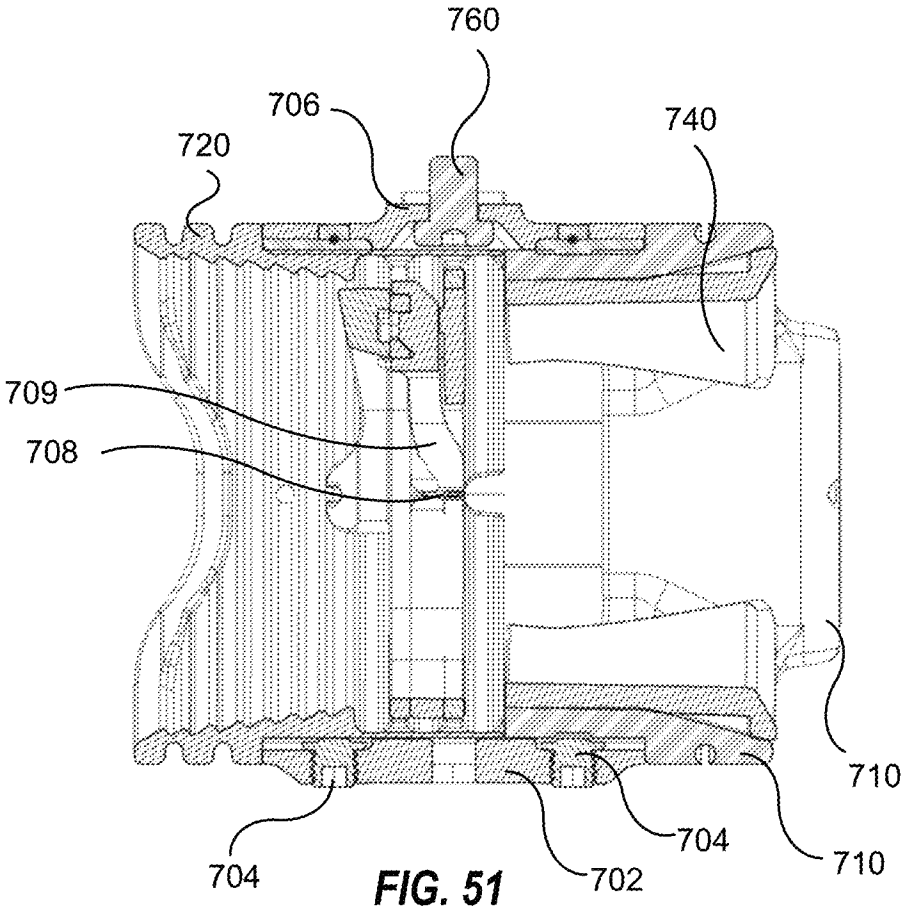
FIG. 51 is a section view of the bow sight taken along line M-M of FIG. 45, according to an example of the present disclosure.

The housing 702 can be configured to be attached to the shaft 606 of the windage assembly 600 by a mount 706 that can be disposed on a side of the housing 702. The mount 706 can be configured to support the bow sight 700 and ensure the bow sight 700 remains aligned with a setting of the support structure 200, 300, 400, 500 and 600. For example, the mount 706 can define a channel in which at least a portion of the shaft 606 of the windage assembly 600 can extend. Furthermore, as shown in FIG. 51, a mount fastener 760 can extend through the housing 702 and into the shaft 606 to attach the bow sight 700 to the windage assembly 600.

The light pack 710 can include an LED or other light source, and when the light pack 710 and cartridge assembly 720 are attached to the housing 702, the LED can be positioned to direct light at an aiming point. Although not shown, the aiming point can be a point on a lens that is fluorescent and configured to emit light as a result of being illuminated by the LED. Alternatively, as shown in FIG. 45, the cartridge assembly 720 can include one or more pins 708, 709 that can extend into the field of view through the bow sight 700 from a bottom of the bow sight (e.g., pin 708) and/or a side of the bow sight (e.g., pins 709) and be illuminated by the LED. In some examples, one, some, or all of pins 708, 709 can be adjustable within cartridge assembly 720 such that a user can adjust the position of the pins 708, 709 for the particular situation.

The LED can emit ultraviolet light that is outside of the visible range for a user to eliminate any visible glare from light reflection from the LED off of the lens or pins 708, 709. In some applications, availability of ambient light can cause the aiming point to fluoresce without being illuminated by the LED. The light pack 710 can house an energy source (e.g., a battery) for powering the LED, and the light pack 710 can include a user interface 122 for controlling light output from the LED. The light output can be controlled by one or more buttons 712 to cause the LED to be on or off, to have a selectable brightness, and/or to have a selectable color output.

The housing 702 can include a level 730 that can indicate whether the bow sight 700 and/or the bow 100 is level. This can help to increase the archer's accuracy and ensure the bow sight 700 is properly aligned with the target. The level 730 can be permanently attached to the housing 702 or the level 730 can be removably attached to the housing 702 by a snap fit or other means of attaching the level 730 to the housing 702.

Figure 46:
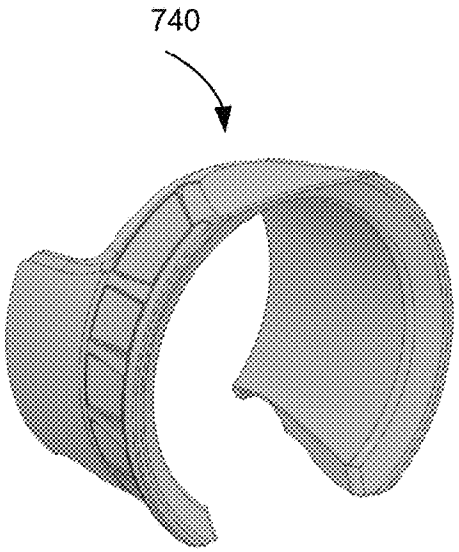
FIG. 46 is a perspective view of an insert of a bow sight, according to an example of the present disclosure.

FIG. 46 is a perspective view of an insert of an alignment ring 46, according to an example of the present disclosure. The alignment ring 740 can have a colored or otherwise high contrast surface that can be positioned to be visible by a user when aiming with the bow sight 700. The alignment ring 740 can include a light refracting surface to reduce glare in the sightline. Furthermore, the alignment ring 740 can be configured to create a more circular field of view through the bow sight 700 as is preferred by some archers. The alignment ring 740 can be configured to attach to the housing by forming a snap fit with the housing 702 and the level 730.

Figure 47:
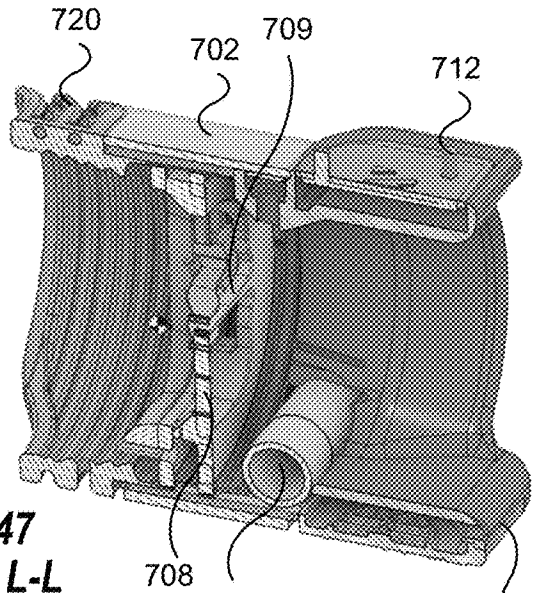
FIG. 47 is a section view of the bow sight taken along line L-L of FIG. 45, according to an example of the present disclosure.
Figure 48:
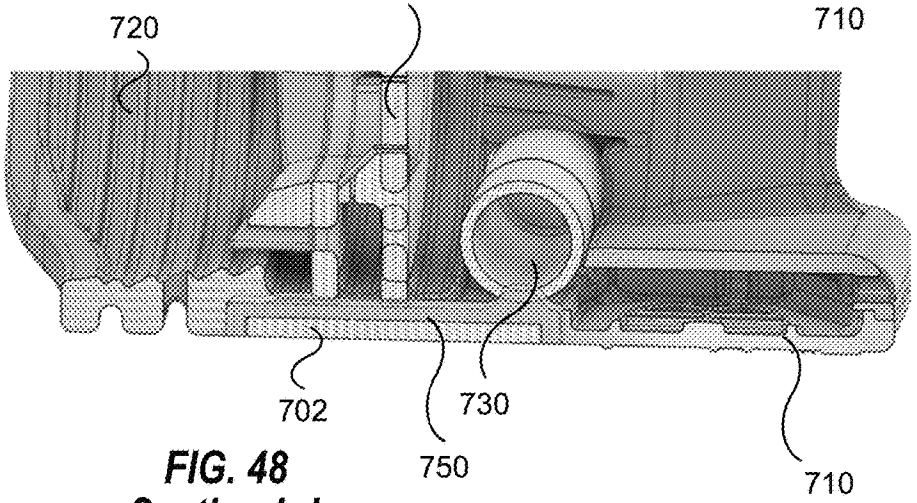
FIG. 48 is a detailed section view of the bow sight taken along line L-L of FIG. 45, according to an example of the present disclosure.

FIG. 47 is a section view of the bow sight 700 taken along line L-L of FIG. 45, according to an example of the present disclosure. The bow sight 700 is shown with the alignment ring 740 removed to better show the light pack 710, the cartridge assembly 720, and the level 730 installed in the housing 702. As shown, the light pack 710, the cartridge assembly 720, and the level 730 can each be inserted at least partially within the housing 702. In some examples, the light pack 710, the cartridge assembly 720, and the level 730 can each be sized to form a snap fit with the housing 702. To help ensure a tight fit, the housing 702 can further include one or more rubber pads 750 as shown in FIG. 48, which is a detail view of the section view L-L shown in FIG. 47. The rubber pads 750 can be disposed between the housing 702 and each of the light pack 710, the cartridge assembly 720, and the level 730. The rubber pads 750 can further include one or more bumps or ridges formed into the rubber pads 750 to ensure a tight fit with each of the light pack 710, the cartridge assembly 720, and the level 730.

Figure 50:
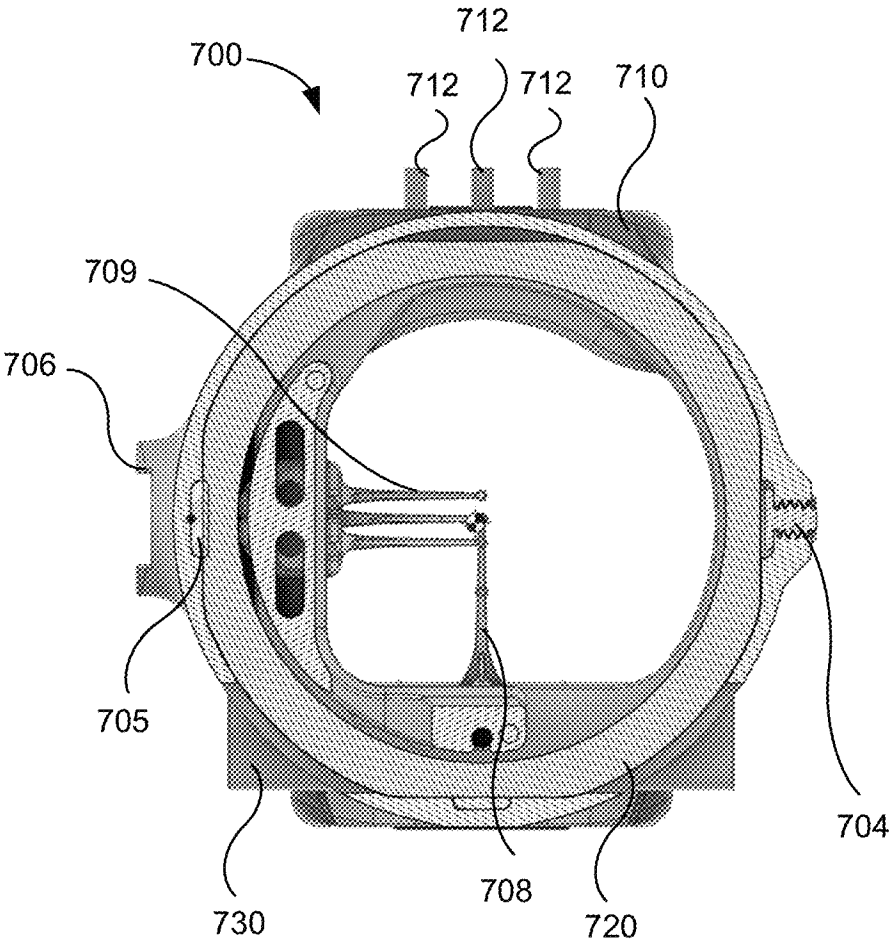
FIG. 50 is another section view of the bow sight taken along line K-K of FIG. 44, according to an example of the present disclosure.
Figure 49:
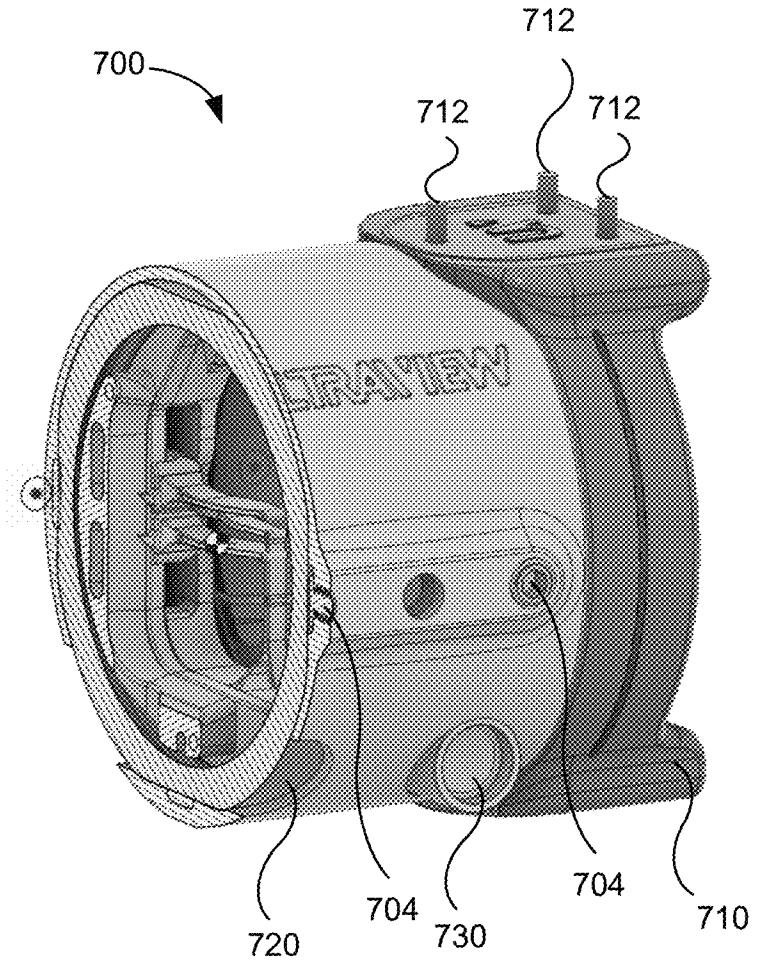
FIG. 49 is a perspective section view of the bow sight taken along line K-K of FIG. 44, according to an example of the present disclosure.

FIG. 49 is a perspective section view while FIG. 50 is a front section view of the bow sight 700 taken along line K-K of FIG. 44, according to an example of the present disclosure. As shown, the bow sight 700 can include one or more set screws 704 that can extend through the housing 702 to secure the light pack 710 and the cartridge assembly 720 in place. The set screws 704 can include a flange on an inner side of the set screw 704 to prevent the set screw 704 from falling out of the housing 702 when loosened. To further secure the light pack 710 and the cartridge assembly 720 in the housing 702, the bow sight 700 can further include a rubber stop 705 that can be disposed between the housing and the light pack 710 and the cartridge assembly 720. When the set screw 704 is tightened, the light pack 710 and the cartridge assembly 720 can be pushed against the rubber stop 705 to create friction fit.

FIG. 51 is a section view of the bow sight taken along line M-M of FIG. 45, according to an example of the present disclosure. As shown, the alignment ring 740 can be configured to fit at least partially over the light pack 710. Furthermore, the set screws 704 can contact both the light pack 710 and the cartridge assembly 720. The mount 706 can further include a mount fastener 760 that can extend through the housing 702 and be configured to attach to the shaft 606 of the windage assembly 600. In this way, the bow sight 700 can be securely attached to the windage assembly 600.

The cartridge assembly 720 can include a cartridge outer housing 142, an O-ring 144, a cartridge inner housing 146, a lens 150, and an aiming point 152. The outer housing 146 can be keyed with one or more notches 141, so that the cartridge assembly 720 can be installed in the bore of the housing 702 at a predetermined rotational orientation. As illustrated, the cartridge assembly 720 can be secured within the scope housing 110 with a set screw. It is contemplated that the cartridge assembly 720 can alternatively or additionally be secured within the scope housing 110 with one or more magnets.

The disclosed technology described herein can be further understood according to the following clauses:

Clause 1: A support system for an optical sighting device of a bow, the support system comprising: a support structure configured to attach to a bow; an elevation assembly configured to move along an elevation direction relative to the support structure; an elevation actuator configured to cause the elevation assembly to move along the elevation direction when the elevation actuator is actuated; a windage assembly configured to move along a windage direction relative to the support structure, the windage direction being approximately perpendicular to the elevation direction; and a windage actuator configured to cause the windage assembly to move along the windage direction when the windage actuator is actuated, the windage actuator being disposed at least partially in the elevation actuator.

Clause 2: The support system of clause 1, the elevation actuator comprising a first wheel and the windage actuator comprising a second wheel, the second wheel being disposed at least partially in a recess of the first wheel and aligned axially.

Clause 3: The support system of clause 1 or clause 2, the windage actuator being concentric with the elevation actuator.

Clause 4: The support system of any of the preceding clauses, the elevation assembly comprising a pinion gear configured to engage with a rack gear disposed on the support structure.

Clause 5: The support system of clause 4, the elevation assembly further comprising a wheel, the wheel and the pinion gear being connected to each other via a spline joint.

Clause 6: The support system of clause 4 or clause 5, the pinion gear comprising angled teeth that converge toward each other from a first side of the pinion gear to a second side of the pinion gear; and the rack gear comprising corresponding angled teeth that converge toward each other from a second side of the rack gear to a first side of the rack gear, the first and second sides of the pinion gear corresponding to the first and second sides of the rack gear.

Clause 7: The support system of clause 6, the pinion gear receiving a force causing the pinion gear to move along its axis to cause the angled teeth to engage with the corresponding angled teeth of the rack gear.

Clause 8: The support system of clause 7, the support system further comprising an O-ring configured to apply the force to the pinion gear.

Clause 9: The support system of clause 8, the O-ring engaging with a ramped surface to cause the O-ring to apply the force to the pinion gear.

Clause 10: The support system of any of clauses 5-9, the pinion gear comprising an aperture extending therethrough along an axis of the pinion gear.

Clause 11: The support system of clause 10, wherein at least a portion of the windage actuator extends through the aperture of the pinion gear.

Clause 12: The support system of any of the preceding clauses, wherein the windage actuator comprises: a wheel; a lead screw attached to the wheel; and a shaft configured to engage with the lead screw and to support the optical sighting device, wherein the wheel is configured to transfer a torque to the lead screw thereby causing the shaft to rotate and move along the windage direction.

Clause 13: The support system of clause 12, wherein the wheel is keyed to the lead screw.

Clause 14: The support system of clause 12 or clause 13, the wheel being configured to move between a locked position and an unlocked position, wherein, when the wheel is in the locked position, the wheel is prevented from rotating and causing the shaft to move along the windage direction, and wherein, when the wheel is in the unlocked position, the wheel is permitted to rotate and cause the shaft to move along the windage direction.

Clause 15: The support system of clause 14, the windage actuator further comprising a detent configured to retain the wheel in the locked position or in the unlocked position and to provide position feedback when the wheel is rotated.

Clause 16: The support system of clause 14 or clause 15, the elevation assembly further comprising a protrusion and the wheel further comprising a recess configured to receive the protrusion, wherein when the wheel is in the locked position the protrusion extends into the recess, and wherein when the wheel is in the unlocked position the protrusion is removed from the recess.

Clause 17: The support system of any of clauses 12-16 the shaft further comprising a recess configured to receive a guide member, the guide member configured to prevent the shaft from rotating relative to the support structure.

Clause 18: The support system of any of the preceding clauses, the elevation actuator comprising a lever configured to transition between a locked position and an unlocked position, wherein, when the lever is in the locked position, the elevation assembly is prevented from moving along the elevation direction by forces applied to the elevation assembly not by the elevation actuator, and wherein, when the lever is in the unlocked position, the elevation assembly is permitted to move along the elevation direction.

Clause 19: The support system of clause 18, the lever configured to cause a first housing and a second side of the elevation assembly to move toward each other when in the locked position to engage the support structure and prevent the elevation assembly from moving along the elevation direction.

Clause 20: The support system of clause 19, the first housing and the second side of the elevation assembly comprising recesses and the rack gear further comprising corresponding recesses on a first side and a second side of the rack gear.

Clause 21: The support system of clause 20 further comprising a plurality of pins disposed between the recesses and the corresponding recesses.

Clause 22: The support system of any of the preceding clauses, the support structure further comprising a yaw block configured to permit the elevation assembly and the windage assembly to rotate around a roll axis extending through the yaw block generally parallel with a line of sight extending through the optical sighting device.

Clause 23: The support system of clause 22, the yaw block further configured to permit the elevation assembly and the windage assembly to rotate around a yaw axis extending through the yaw block generally perpendicular with a line of sight extending through the optical sighting device.

Clause 24: The support system of any of clause 22 or clause 23, the yaw block comprising a first spring and a first block configured to cause the yaw block to maintain its position when adjusting the yaw block about the roll axis.

Clause 25: The support system of any of clauses 22-24, the yaw block comprising an expansion joint configured to permit a first side and a second side of the yaw block to move in relation to each other to cause a parallel clamping force on a rail of the yaw block to which the yaw block is attached.

Clause 26: The support system of clause 25, the rail comprising a second spring and a second block configured to cause the yaw block to maintain its position when adjusting the yaw block about the yaw axis.

Clause 27: The support system of any of clauses 24-26, the yaw block or the rail further comprising flanged set screws configured to engage the first block or the second block, the flanged set screws configured to prevent the flanged set screws from falling out of the yaw block or the rail.

Clause 28: The support system of any of the preceding clauses further comprising a sight tape and an indicator, the indicator comprising a nut integrated into the indicator.

Clause 29: The support system of clause 28, wherein the sight tape is a first site tape and the indicator is a first indicator, the first sight tape and the second sight tape being disposed on a first side of the support structure, the support system further comprising a second sight tape and a second indicator disposed on a second side of the support structure, the second indicator comprising a nut integrated into the second indicator.

Clause 30: The support system of any of the preceding clauses, the support structure further comprising a lock member configured to transition between a locked position and an unlocked position, wherein the lock member is configured to prevent the elevation assembly from being removed from the support structure when in the locked position, and wherein the lock member is configured to permit the elevation assembly to be removed from the support structure when in the unlocked position.

Clause 31: The support system of clause 30, the lock member being configured to be moved out of a pathway of the elevation assembly without requiring any tools.

Clause 32: The support system of clause 31, the lock member being spring-loaded.

Clause 33: The support system of clause 31 or clause 32, the lock member configured to transition from the locked position to the unlocked position when the elevation assembly is pushed against the lock member when installed onto the support structure.

Clause 34: The support system of any of the preceding clauses, the optical sighting device comprising a bow sight.

Clause 35: The support system of clause 34, the bow sight further comprising a snap-fit alignment ring configured to change a viewing area of the bow sight.

Clause 36: The support system of clause 34, the bow sight further comprising a light cartridge configured to engage with the bow sight via a snap fit.

Clause 37: The support system of clause 36, the bow sight further comprising a flanged set screw configured to secure the light cartridge or a lens cartridge.

Clause 38: The support system of any of the preceding clauses, wherein the elevation actuator comprises an interchangeable actuator.

Clause 39: The support system of clause 38, wherein the interchangeable actuator comprises interchangeable polymer grips.

Clause 40: A support system for an optical sighting device of a bow, the support system comprising: an elevation assembly configured to move along an elevation direction relative to the support structure, the elevation assembly comprising a pinion gear, the pinion gear comprising angled teeth that converge toward each other from a first side of the pinion gear to a second side of the pinion gear; a rack gear comprising corresponding angled teeth that converge toward each other from a second side of the rack gear to a first side of the rack gear, the first and second sides of the pinion gear corresponding to the first and second sides of the rack gear; and an O-ring configured to apply a force to the pinion gear along an axis of the pinion gear to cause the angled teeth to engage with the corresponding angled teeth of the rack gear.

Clause 41: The support system of clause 40, the O-ring engaging with a ramped surface to cause the O-ring to apply the force to the pinion gear.

Clause 42: The support system of clause 41 further comprising an elevation actuator configured to cause the elevation structure to move along the elevation direction when the elevation actuator is actuated.

Clause 43: The support system of clause 42 further comprising a windage assembly configured to move along a windage direction relative to the support structure, the windage direction being approximately perpendicular to the elevation direction.

Clause 44: The support system of clause 42 further comprising a windage actuator configured to cause the windage assembly to move along the windage direction when the windage actuator is actuated, the windage actuator being disposed at least partially in the elevation actuator.

Clause 45: The support system of clause 44, the windage actuator being concentric with the elevation actuator.

Clause 46: A support system for an optical sighting device of a bow, the support system comprising: a support structure configured to attach to a bow; an elevation assembly configured to move along an elevation direction relative to the support structure, the elevation assembly comprising: a pinion gear, the pinion gear comprising an aperture extending therethrough along an axis of the pinion gear; and an elevation actuator configured to engage the pinion gear and cause the elevation structure to move along the elevation direction when the elevation actuator is actuated; and a windage assembly configured to move along a windage direction relative to the support structure, the windage direction being approximately perpendicular to the elevation direction, the windage assembly comprising a windage actuator extending at least partially through the aperture of the pinion gear and configured to cause the windage assembly to move along the windage direction when the windage actuator is actuated.

Clause 47: The support system of clause 46, wherein the windage actuator further comprises: a wheel; a lead screw attached to the wheel; and a shaft configured to engage with the lead screw and to support the optical sighting device, wherein the wheel is configured to transfer a torque to the lead screw thereby causing the shaft to rotate and move along the windage direction.

Clause 48: The support system of clause 47, wherein the wheel is keyed to the lead screw.

Clause 49: The support system of clause 46 or clause 47, the wheel being configured to move between a locked position and an unlocked position, wherein, when the wheel is in the locked position, the wheel is prevented from rotating and causing the shaft to move along the windage direction, and wherein, when the wheel is in the unlocked position, the wheel is permitted to rotate and cause the shaft to move along the windage direction.

Clause 50: The support system of clause 49, the windage actuator further comprising a detent configured to retain the wheel in the locked position or in the unlocked position and to provide position feedback when the wheel is rotated.

Clause 51: The support system of clause 49 or clause 50, the elevation assembly further comprising a protrusion and the wheel further comprising a recess configured to receive the protrusion, wherein when the wheel is in the locked position the protrusion extends into the recess, and wherein when the wheel is in the unlocked position the protrusion is removed from the recess.

Clause 52: A windage assembly for a bow sight comprising: a shaft configured to support the bow sight; a lead screw configured to engage the shaft; and a wheel attached to the lead screw, the wheel configured to transfer a torque to the lead screw thereby causing the shaft to rotate and move along a windage direction, the wheel being configured to move between a locked position and an unlocked position, wherein, when the wheel is in the locked position, the wheel is prevented from rotating and causing the shaft to move along the windage direction, and wherein, when the wheel is in the unlocked position, the wheel is permitted to rotate and cause the shaft to move along the windage direction.

Clause 53: The windage assembly of clause 52, wherein the wheel is keyed to the lead screw.

Clause 54: The windage assembly of clause 53, the windage actuator further comprising a detent configured to retain the wheel in the locked position or in the unlocked position.

Clause 55: The windage assembly of clause 54, the wheel further comprising one or more recesses disposed along an inner surface of the wheel, the detent configured to engage the one or more recesses to retain the wheel in the locked position or in the unlocked position.

Clause 56: The windage assembly of clause 55, the detent and one or more recesses configured to provide position feedback when the wheel is rotated.

Clause 57: The support system of any of clauses 52-56, the wheel further comprising a recess configured to receive a protrusion of an elevation assembly, wherein when the wheel is in the locked position the protrusion extends into the recess, and wherein when the wheel is in the unlocked position the protrusion is removed from the recess.

While the present disclosure has been described in connection with a plurality of exemplary aspects, as illustrated in the various figures and discussed above, it is understood that other similar aspects can be used, or modifications and additions can be made to the described subject matter for performing the same function of the present disclosure without deviating therefrom. In this disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims.

What is claimed is:

1. A support system for an optical sighting device of a bow, the support system comprising:

a support structure configured to attach to a bow;

an elevation assembly configured to move along an elevation direction relative to the support structure;

an elevation actuator configured to cause the elevation assembly to move along the elevation direction when the elevation actuator is actuated;

a windage assembly configured to move along a windage direction relative to the support structure, the windage direction being approximately perpendicular to the elevation direction; and a windage actuator configured to cause the windage assembly to move along the windage direction when the windage actuator is actuated, the windage actuator being disposed at least partially in the elevation actuator.

2. The support system of claim 1, the elevation actuator comprising a first wheel and the windage actuator comprising a second wheel, the second wheel being disposed at least partially in a recess of the first wheel and aligned axially.

3. The support system of claim 1, the windage actuator being concentric with the elevation actuator.

4. The support system of claim 1, the elevation assembly comprising a pinion gear configured to engage with a rack gear disposed on the support structure.

5. The support system of claim 4, the pinion gear comprising angled teeth that converge toward each other from a first side of the pinion gear to a second side of the pinion gear; and the rack gear comprising corresponding angled teeth that converge toward each other from a second side of the rack gear to a first side of the rack gear, the first and second sides of the pinion gear corresponding to the first and second sides of the rack gear.

6. The support system of claim 5, the pinion gear receiving a force causing the pinion gear to move along its axis to cause the angled teeth to engage with the corresponding angled teeth of the rack gear.

7. The support system of claim 6, the support system further comprising an O-ring configured to apply the force to the pinion gear.

8. The support system of claim 7, the O-ring engaging with a ramped surface to cause the O-ring to apply the force to the pinion gear.

9. The support system of claim 1, wherein the windage actuator comprises:

a wheel;

a lead screw attached to the wheel; and a shaft configured to engage with the lead screw and to support the optical sighting device, wherein the wheel is configured to transfer a torque to the lead screw thereby causing the shaft to rotate and move along the windage direction.

10. The support system of claim 9, the wheel being configured to move between a locked position and an unlocked position, wherein, when the wheel is in the locked position, the wheel is prevented from rotating and causing the shaft to move along the windage direction, and wherein, when the wheel is in the unlocked position, the wheel is permitted to rotate and cause the shaft to move along the windage direction.

11. The support system of claim 10, the windage actuator further comprising a detent configured to retain the wheel in the locked position or in the unlocked position and to provide position feedback when the wheel is rotated.

12. The support system of claim 10, the elevation assembly further comprising a protrusion and the wheel further comprising a recess configured to receive the protrusion, wherein when the wheel is in the locked position the protrusion extends into the recess, and wherein when the wheel is in the unlocked position the protrusion is removed from the recess.

13. The support system of claim 1, the elevation actuator comprising a lever configured to transition between a locked position and an unlocked position, wherein, when the lever is in the locked position, the elevation assembly is prevented from moving along the elevation direction by forces applied to the elevation assembly not by the elevation actuator, and wherein, when the lever is in the unlocked position, the elevation assembly is permitted to move along the elevation direction.

14. The support system of claim 13, the lever configured to cause a first housing and a second housing of the elevation assembly to move toward each other when in the locked position to engage the support structure and prevent the elevation assembly from moving along the elevation direction.

15. The support system of claim 1, the support structure further comprising a yaw block configured to permit the elevation assembly and the windage assembly to rotate around a roll axis extending through the yaw block generally parallel with a line of sight extending through the optical sighting device.

16. The support system of claim 15, the yaw block further configured to permit the elevation assembly and the windage assembly to rotate around a yaw axis extending through the yaw block generally perpendicular with a line of sight extending through the optical sighting device.

17. The support system of claim 15, the yaw block comprising an expansion joint configured to permit a first side and a second side of the yaw block to move in relation to each other to cause a parallel clamping force on a rail of the yaw block to which the yaw block is attached.

18. The support system of claim 1, the support structure further comprising a lock member configured to transition between a locked position and an unlocked position, wherein the lock member is configured to prevent the elevation assembly from being removed from the support structure when in the locked position, and wherein the lock member is configured to permit the elevation assembly to be removed from the support structure when in the unlocked position.

19. A support system for an optical sighting device of a bow, the support system comprising:

an elevation assembly configured to move along an elevation direction relative to a support structure, the elevation assembly comprising a pinion gear, the pinion gear comprising angled teeth that converge toward each other from a first side of the pinion gear to a second side of the pinion gear;

a rack gear comprising corresponding angled teeth that converge toward each other from a second side of the rack gear to a first side of the rack gear, the first and second sides of the pinion gear corresponding to the first and second sides of the rack gear; and an O-ring configured to apply a force to the pinion gear along an axis of the pinion gear to cause the angled teeth to engage with the corresponding angled teeth of the rack gear.

20. A support system for an optical sighting device of a bow, the support system comprising:

a support structure configured to attach to a bow;

an elevation assembly configured to move along an elevation direction relative to the support structure, the elevation assembly comprising:

a pinion gear, the pinion gear comprising an aperture extending therethrough along an axis of the pinion gear; and an elevation actuator configured to engage the pinion gear and cause the elevation asssembly to move along the elevation direction when the elevation actuator is actuated; and a windage assembly configured to move along a windage direction relative to the support structure, the windage direction being approximately perpendicular to the elevation direction, the windage assembly comprising a windage actuator extending at least partially through the aperture of the pinion gear and configured to cause the windage assembly to move along the windage direction when the windage actuator is actuated.

* * * * *